US010836976B2

(12) United States Patent
Carranza et al.

(10) Patent No.: US 10,836,976 B2
(45) Date of Patent: Nov. 17, 2020

(54) POLYMERIC VISCOSITY MODIFIERS FOR USE IN LUBRICANTS

(71) Applicant: Afton Chemical Corporation, Richmond, VA (US)

(72) Inventors: Arturo Carranza, Henrico, VA (US); Sheng Jiang, Glen Allen, VA (US)

(73) Assignee: AFTON CHEMICAL CORPORATION, Richmond, VA (US)

( * ) Notice: Subject to any disclaimer, the term of this patent is extended or adjusted under 35 U.S.C. 154(b) by 12 days.

(21) Appl. No.: 16/039,012

(22) Filed: Jul. 18, 2018

(65) Prior Publication Data

US 2020/0024542 A1 Jan. 23, 2020

(51) Int. Cl.
*C10M 143/04* (2006.01)
*C10M 145/22* (2006.01)
(Continued)

(52) U.S. Cl.
CPC ..... *C10M 143/04* (2013.01); *C10M 133/12* (2013.01); *C10M 133/48* (2013.01);
(Continued)

(58) Field of Classification Search
CPC ..... C08F 255/02; C10N 2230/041; C10N 2030/04; C10N 2030/06; C10N 2040/25; C10M 2217/06
See application file for complete search history.

(56) References Cited

U.S. PATENT DOCUMENTS 3,256,185 A 6/1966 Le Suer
3,278,550 A 10/1966 Norman et al.
(Continued)

FOREIGN PATENT DOCUMENTS

EP 0612839 A1 8/1994
GB 1065595 4/1967
(Continued)

OTHER PUBLICATIONS

Randall, James C. "A review of high resolution liquid 13carbon nuclear magnetic resonance characterizations of ethylene-based polymers." Journal of Macromolecular Science—Reviews in Macromolecular Chemistry and Physics 29.2-3 (1989): 201-317.
(Continued)

*Primary Examiner* — Vishal V Vasisth
(74) *Attorney, Agent, or Firm* — Mendelsohn Dunleavy, PC

(57) ABSTRACT

A lubricating oil composition having greater than 50 wt % of a base oil and 0.1 wt % to 20 wt %, both based on the total weight of the lubricating oil composition, of a dispersant viscosity modifier obtainable by:

A) reacting: a) at least one of a lactone of formula (I) or a derivative thereof:

(I)

wherein X is oxygen, and R is an optionally substituted hydrocarbylene group having from 1 to 20 carbon atoms; and b) at least one compound selected from amines, alcohols and oxazolines; and B) reacting the reaction product of step A) onto an acylated olefin copolymer obtainable by acylating a copolymer of ethylene and one or more $C_3$-$C_{10}$ alpha-olefins having a number average molecular weight of
(Continued)

5,000 to 200,000 g/mol as measured by GPC, with an acylating agent. Methods employing the lubricating oil compositions and uses of the lubricating compositions as engine oils are also described.

34 Claims, 3 Drawing Sheets
(1 of 3 Drawing Sheet(s) Filed in Color)

(51) Int. Cl.

| | |
|---|---|
| ***C10M 133/12*** | (2006.01) |
| ***C10M 133/48*** | (2006.01) |
| ***C10M 159/12*** | (2006.01) |
| *C10N 30/02* | (2006.01) |
| *C10N 40/25* | (2006.01) |

(52) U.S. Cl.
CPC ..... *C10M 145/22* (2013.01); *C10M 159/12* (2013.01); *C10M 2203/1006* (2013.01); *C10M 2205/08* (2013.01); *C10M 2207/021* (2013.01); *C10M 2207/044* (2013.01); *C10N 2030/02* (2013.01); *C10N 2040/252* (2020.05)

(56) References Cited

U.S. PATENT DOCUMENTS

| | | | | |
|---|---|---|---|---|
| 3,312,619 | A | 4/1967 | Vineyard | |
| 3,390,086 | A | 6/1968 | O'Halloran | |
| 3,403,102 | A | 9/1968 | Le Suer | |
| 3,458,530 | A | 7/1969 | Siegel et al. | |
| 3,470,098 | A | 9/1969 | O'Halloran | |
| 3,502,677 | A | 3/1970 | Le Suer | |
| 3,516,944 | A * | 6/1970 | Litt | C06B 23/001 524/386 |
| 3,519,564 | A | 7/1970 | Vogel | |
| 3,546,243 | A | 12/1970 | Coupland | |
| 3,573,205 | A | 3/1971 | Lowe et al. | |
| 3,634,515 | A | 1/1972 | Piasek et al. | |
| 3,649,229 | A | 3/1972 | Otto | |
| 3,708,522 | A | 1/1973 | LeSuer | |
| 3,749,695 | A | 7/1973 | de Vries | |
| 3,859,318 | A | 1/1975 | Lesuer | |
| 3,865,740 | A | 2/1975 | Goldschmidt | |
| 3,865,813 | A | 2/1975 | Gergel | |
| 3,954,639 | A | 5/1976 | Liston | |
| 4,152,499 | A | 5/1979 | Boerzel et al. | |
| 4,234,435 | A | 11/1980 | Meinhardt et al. | |
| 4,259,194 | A | 3/1981 | deVries et al. | |
| 4,259,195 | A | 3/1981 | King et al. | |
| 4,261,843 | A | 4/1981 | King et al. | |
| 4,263,152 | A | 4/1981 | King et al. | |
| 4,265,773 | A | 5/1981 | deVries et al. | |
| 4,272,387 | A | 6/1981 | King et al. | |
| 4,283,295 | A | 8/1981 | deVries et al. | |
| 4,285,822 | A | 8/1981 | deVries et al. | |
| 4,340,689 | A | 7/1982 | Joffrion | |
| 4,933,098 | A * | 6/1990 | Gutierrez | C08G 63/60 508/222 |
| 4,954,276 | A * | 9/1990 | Gutierrez | C08G 63/60 508/190 |
| 4,954,277 | A * | 9/1990 | Gutierrez | C08G 63/60 508/190 |
| 4,963,275 | A * | 10/1990 | Gutierrez | C08G 63/912 508/192 |
| 5,026,495 | A | 6/1991 | Emert et al. | |
| 5,039,307 | A | 8/1991 | Herbstman et al. | |
| 5,075,383 | A | 12/1991 | Migdal et al. | |
| 5,128,056 | A | 7/1992 | Gutierrez et al. | |
| 5,241,003 | A | 8/1993 | Degonia et al. | |
| 5,262,484 | A * | 11/1993 | Coleman | C08F 255/00 427/2.13 |
| 5,266,223 | A | 11/1993 | Song et al. | |
| 5,334,321 | A | 8/1994 | Harrison et al. | |
| 5,385,687 | A | 1/1995 | Emert et al. | |
| 5,650,381 | A | 7/1997 | Gatto et al. | |
| 5,739,355 | A | 4/1998 | Gateau et al. | |
| 5,851,964 | A | 12/1998 | Furey et al. | |
| 5,883,057 | A | 3/1999 | Roell, Jr. et al. | |
| 6,107,257 | A | 8/2000 | Valcho et al. | |
| RE37,363 | E | 9/2001 | Gatto et al. | |
| 6,300,291 | B1 | 10/2001 | Hartley et al. | |
| 6,723,685 | B2 | 4/2004 | Hartley et al. | |
| RE38,929 | E | 1/2006 | Gatto et al. | |
| 7,214,649 | B2 | 5/2007 | Loper et al. | |
| RE40,595 | E | 12/2008 | Gatto et al. | |
| 7,645,726 | B2 | 1/2010 | Loper | |
| 7,732,390 | B2 | 6/2010 | Kadkhodayan et al. | |
| 7,897,696 | B2 | 3/2011 | Huang et al. | |
| 8,048,831 | B2 | 11/2011 | Loper | |
| 8,614,277 | B2 | 12/2013 | Kiss et al. | |
| 8,912,133 | B2 | 12/2014 | Gieselman et al. | |
| 9,441,063 | B2 | 9/2016 | Cruz et al. | |
| 2008/0182768 | A1* | 7/2008 | Devlin | C08F 8/32 508/287 |
| 2012/0101017 | A1 | 4/2012 | Duggal | |
| 2016/0257862 | A1 | 9/2016 | Yoshimoto et al. | |

FOREIGN PATENT DOCUMENTS

| | | | |
|---|---|---|---|
| GB | 2140811 | A | 12/1984 |
| WO | WO9406897 | A1 | 3/1994 |

OTHER PUBLICATIONS

-Iansen, Redford, & Øysæd. (1996). Improvement in the determination of triad distributions in ethylene-propylene mpolymers by 13C nuclear magnetic resonance. Polymer, 37(1), 19-24.

Forte, Giuseppe, and Sara Ronca. "Synthesis of disentangled Ultra-High Molecular Weight Polyethylene: influence of eaction medium on material properties." International Journal of Polymer Science 2017 (2017).

* cited by examiner

POLYMERIC VISCOSITY MODIFIERS FOR USE IN LUBRICANTS

TECHNICAL FIELD

The disclosure relates to lubricant oils and additive compositions containing polymeric dispersant viscosity modifiers and to methods for making the polymeric dispersant viscosity modifiers. The dispersant viscosity modifier is obtainable by reacting at least one lactone or lactone derivative and amine, alcohol or oxazoline, and reacting the reaction product onto an acylated olefin copolymer. The dispersant viscosity modifier may provide one or more of dispersancy, soot handling, and improved thin film and boundary layer friction in engine oil compositions.

BACKGROUND

Dispersant viscosity modifiers are employed for their soot and sludge handing properties in engine oils, particularly in heavy duty diesel oils. These dispersant viscosity modifiers also contribute to the overall viscometric performance of the finished oil. Dispersant viscosity modifiers are beneficial as they can be tailored to fulfill multiple roles in finished oil formulations, including those of antioxidants, friction/anti-wear agents, and in some cases detergents. This versatility allows greater flexibility in formulation of the lubricant oils to adjust component treat rates to enhance overall performance and/or reduce cost.

U.S. Pat. No. 4,866,141 relates to $C_5$-$C_9$ lactone derived materials made by simultaneously reacting: (a) a $C_5$-$C_9$ lactone with (b) a polyamine, a polyol, or an amino alcohol and (c) a hydrocarbyl substituted $C_4$-$C_{10}$ monounsaturated dicarboxylic acid producing material, e.g. polyisobutenyl succinimide. The dicarboxylic acid producing material is preferably made by reacting a polymer of a $C_2$ to $C_{10}$ monoolefin such as polyisobutylene, having a molecular weight of about 300 to 10,000 with a $C_4$ to $C_{10}$ monounsaturated acid, anhydride or ester, preferably maleic anhydride.

U.S. Pat. No. 5,385,687 relates to an oil soluble dispersant additive useful in oleaginous compositions selected from fuels and lubricating oils comprising the reaction products of: (i) at least one intermediate adduct comprised of the reaction products of (a) at least one polyanhydride, and (b) at least one of polyamines, polyols, and amino alcohols, and at least (ii) at least one of (a) a long chain hydrocarbyl substituted $C_4$-$C_{10}$ dicarboxylic acid producing material; (b) a long chain hydrocarbyl substituted hydroxyl aromatic material and an aldehyde; or (c) an aldehyde and a reaction product of a hydrocarbyl substituted $C_3$-$C_{10}$ monocarboxylic or $C_4$-$C_{10}$ dicarboxylic acid or anhydride and an amine substituted hydroxyl aromatic compound.

SUMMARY AND TERMS

The present disclosure relates to lubricating oil compositions comprising a dispersant viscosity modifier, methods of preparing the dispersant viscosity modifier and methods and uses of the dispersant viscosity modifier and the lubricating oil compositions.

In a first aspect, the disclosure relates to a lubricating oil composition including a dispersant viscosity modifier. The lubricating oil composition of the present disclosure may include greater than 50 wt % of a base oil, based on the total weight of the lubricating oil composition, and 0.1 wt % to 20 wt %, based on the total weight of the lubricating oil composition, of a dispersant viscosity modifier obtainable by:

A) forming a reaction product by reacting:

a) at least one of a lactone of formula (I) or a derivative thereof:

(I)

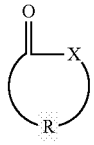

wherein X is oxygen, and R is an optionally substituted hydrocarbylene group having from 1 to 20 carbon atoms, wherein the hydrocarbylene group can be substituted with 1-3 substituents independently selected from halogen, hydroxyl, nitro, cyano, carboxy, and an alkyl or alkenyl group having 1 to 32 carbon atoms which may be linear or branched; and b) at least one compound selected from: a linear, branched cyclic or aromatic amine comprising at least one primary or secondary amino group; at least one primary, secondary, or tertiary alkyl alcohol or primary, secondary, or tertiary alkenyl alcohol; and an oxazoline; and B) reacting the reaction product of step A) onto an acylated olefin copolymer obtainable by acylating a copolymer of ethylene and one or more $C_3$-$C_{10}$ alpha-olefins having a number average molecular weight (Mn) of 5,000 to 200,000 g/mol as measured by GPC, with an acylating agent.

In the foregoing embodiment, the dispersant viscosity modifier may be present in an amount of from about 0.1 wt % to about 10 wt %, or from about 0.1 wt % to about 5 wt %, or from about 0.5 wt % to about 8 wt %, or from about 1 wt % to 5 wt % in the lubricating oil composition, based on the total weight of the lubricating oil composition.

In each of the foregoing embodiments, the base oil may be selected from any one of a Group II base oil having at least 90 wt % saturates, a Group III base oil having at least 90 wt % saturates, a Group IV base oil, a Group V base oil and mixtures of two or more thereof.

In each of the foregoing embodiments, the copolymer may be an ethylene-propylene copolymer.

In each of the foregoing embodiments, the copolymer may be acylated with an ethylenically unsaturated acylating agent having at least one carboxylic acid or carboxylic anhydride group.

In each of the foregoing embodiments, the acylating agent may be maleic anhydride.

In each of the foregoing embodiments, component b) may be an N-arylphenylene diamine of the formula II:

II

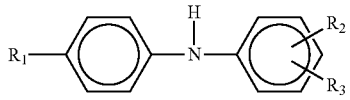

wherein $R_1$ is hydrogen, —NH-aryl, —NH-arylalkyl, —NH-alkyl or a branched or straight chain radical having from 4 to 24 carbon atoms selected from an alkyl group, an alkenyl group, an alkoxyl group, an aralkyl group, an alkaryl group, a hydroxyalkyl group and an aminoalkyl group; $R_2$ is —$NH_2$, $CH_2$—$(CH_2)_n$—$NH_2$, or $CH_2$-aryl-$NH_2$, in which n has a value from 1 to 10; and $R_3$ is selected from a hydrogen, an alkyl group, an alkenyl group, an alkoxyl group, an aralkyl group, and an alkaryl group having from 4 to 24 carbon atoms. Preferably, in each of the foregoing embodiments component b) may be selected from the group consisting of 1-(2-amino-ethyl)imidazolidin-2-one, 4-(3-aminopropyl) morpholine, 3-(dimethylamino)-1-propylamine, N-phenyl-p-phenylenediamine, aminopropyl)-2-pyrrolidinone, aminoethyl-acetamide, β-alanine methyl ester, 1-(3-aminopropyl)imidazole, branched β-amines, arylamines, polyetheramines, and poly(arylamines). More preferably, component b) may be selected from the group consisting of N-phenyl-1,4-phenylenediamine, N-phenyl-1,3-phenylendiamine, and N-phenyl-1,2-phenylenediamine Even more preferably, component b) may be N-phenyl-1,4-phenylenediamine.

In each of the foregoing embodiments, the lactone may be selected from acetolactone, propiolactone, butyrolactone, valerolactone, caprolactone, δ-valerolactone, methyl-δ-valero-lactone, ε-caprolactone, methyl-ε-caprolactone, dimethyl-ε-caprolactone, methoxy-ε-caprolactone, cyclohexyl-ε-caprolactone, methylbenzyl-E-caprolactone, caprylolactone, and methyl-caprylolactone. In each of the foregoing embodiments, the lactone may be E-caprolactone.

In each of the foregoing embodiments, the lubricating oil composition may further include one or more of antioxidants, friction modifiers, anti-wear agents, detergents, anti-foam agents, process oil, and dispersants.

In each of the foregoing embodiments, the dispersant viscosity modifier may be further reacted with component c), wherein component c) is at least one compound selected from a linear, branched, cyclic, or aromatic amine including at least one primary or secondary amino group; at least one primary, secondary, or tertiary alkyl alcohol or primary, secondary, or tertiary alkenyl alcohol; and an oxazoline. Component c) may include any one or more of the compounds described herein for component b).

In each of the foregoing embodiments, component c) may be selected from the group consisting of, N-phenyl-1,4-phenylenediamine, N-phenyl-1,3-phenylendiamine, N-phenyl-1,2-phenylenediamine, and dioctyl amine Preferably, component c) may be selected from N-phenyl-1,4-phenylenediamine and dioctyl amine, or component c) may be selected from the group consisting of 2-ethylhexanol, 2-butyloctanol, isomyristyl alcohol, 2-hexyldecanol, isostearyl alcohol, 2-octyldodecanol, 2-decyltetradecanol, 2-dodecylhexadecanol, 2-tetradecyloctadecanol 2-dodecylhexadecanol, 2-hexyloctanol 2-ethylhexanol, 2-hydroxy-2,3-dimethylhexane, 2-butylhexanol, 2-propylhexan-1-ol, 3-Propyl-1-hexanol, 3-methyl-1-heptanol, 3-ethylheptan-1-ol, 2-ethyl-4-methylhexan-1-ol, 2,4-diethylhexan-1-ol, 2-naphthol, benzyl alcohol, 3-phenoxybenzyl alcohol, 2-naphthylmethanol, 9-anthracenemethanol, 1-pyrenemethanol, 2-(9-anthracenylmethoxy)ethanol, 2-(9-anthracenyloxyethanol), and 1-naphthalene methanol. In a preferred embodiment, component c) may be 1-naphthalene methanol, or component c) may be selected from the group consisting of 2-phenyl-2-oxazoline; 2-ethyl-2 oxazoline; 2-methyl-2-oxazoline; 2-benzyl-4,4-dimethyl-2-oxazoline; 2-ethyl-4,4-dimethyl-2 oxazoline; 2,4,4-trimethyl-2-oxazoline; 4,4-dimethyl-2-oxazoline; 2,4,5-trimethyl-3-oxazoline; 2-(2,6-dimethoxyphenyl)-4,4-dimethyl-2-oxazoline; 2-[1-(hydroxymethyl)ethyl] oxazoline; mixtures thereof, and derivatives thereof. In yet other approaches, the oxazoline or derivative thereof includes pendant groups in positions 2, 4, and 5 or combinations thereof wherein the pendant groups are selected from heterocyclic, aromatics, hydrocarbyl groups of $C_1$ to $C_{32}$, and mixtures thereof. In a preferred embodiment, the component c) may be 2-phenyl-2-oxazoline.

In another embodiment, the present invention may be a method of improving the soot or sludge handling capability of an engine oil, including a step of lubricating an engine with any one of the foregoing lubricating oil compositions. The improvement in soot or sludge handling may be measured relative to a same lubricating oil composition that does not contain the dispersant viscosity modifier.

In another embodiment, the present invention may be a method of improving thin film and boundary layer friction in an engine comprising the step of lubricating the engine with any one of the foregoing lubricating oil composition embodiments. The improvement in the thin film and boundary layer friction may be determined relative to a same composition that does not contain the dispersant viscosity modifier.

In another embodiment, the present invention may be a method for improving boundary layer friction in an engine, including the step of lubricating the engine with any one of the foregoing lubricating oil composition embodiments. The improvement in boundary layer friction may be determined relative to a same composition that does not contain the dispersant viscosity modifier. In another embodiment, the present invention may be a method for improving thin film friction in an engine, comprising the step of lubricating the engine with any one of the foregoing lubricating oil composition embodiments. The improvement in thin film friction may be determined relative to a same composition in the absence of the dispersant viscosity modifier.

In another embodiment, the disclosure provides a process for making a polymeric composition including the steps of:

A) forming a reaction product by reacting:

a) a lactone of formula (I) or a derivative thereof:

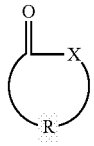

(I)

wherein X is oxygen, and R is an optionally substituted hydrocarbylene group having from 1 to 20 carbon atoms, wherein the hydrocarbylene group can be substituted with 1-3 substituents independently selected from halogen, hydroxyl, nitro, cyano, carboxy, and an alkyl or alkenyl group having 1 to 32 carbon atoms which may be linear or branched; and b) at least one compound selected from: a linear, branched cyclic or aromatic amine comprising at least one primary or secondary amino group; at least one primary, secondary, or tertiary alkyl alcohol or primary, secondary, or tertiary alkenyl alcohol; and an oxazoline;

B) reacting the reaction product of step A) onto an acylated olefin copolymer obtainable by acylating a copolymer of ethylene and one or more $C_3$-$C_{10}$ alpha-olefins having a number average molecular weight Mn of 5,000 to 200,000 g/mol as measured by GPC.

In the foregoing process, step B) may be carried out at a temperature range of from 115° C. to 250° C., preferably 135° C. to 210° C., and more preferably 150° C. to 170° C.

In each of the foregoing processes, in the reaction of step B) the ratio of moles of reaction product of step A) per moles of carboxyl groups of the acylated polymer is from 0.25:1 to 4:1 or from 0.5:1 to 2:1, or more preferably from 0.5:1 to 1:1, or at 0.5:1

In each of the foregoing processes, the acylated olefin copolymer may be further reacted with a component c) prior to reacting with the reaction product of step A), wherein component c) is at least one compound selected from: a linear, branched cyclic or aromatic amine comprising at least one primary or secondary amino group; at least one primary, secondary, or tertiary alkyl alcohol or primary, secondary, or tertiary alkenyl alcohol; and an oxazoline. The reaction of the acylated olefin copolymer and component c) may be carried out at a temperature of from 115° C. to 250° C., preferably 135° C. to 210° C., and more preferably 150° C. to 170° C., for 1 to 5 hours, preferably 2 hrs to 4 hrs, and step B) is carried out at a temperature of from 115° C. to 250° C., preferably 135° C. to 210° C., and more preferably 150° C. to 170° C. The reaction of the acylated olefin copolymer and component c) may be carried out at a constant stir rate in the range of about 100 rpm to 500 rpm, preferably 175 rpm to 425 rpm, and more preferably 250 rpm to 350 rpm, and the reaction product of step A) is added to the reaction mixture and reacted for 2 hrs to 15 hrs, preferably 3 hrs to 12 hrs, more preferably from 4 hrs to 8 hrs and under constant nitrogen flow. Next, the mixture is allowed to cool to a temperature in the range of about 100° C. to 200° C., preferably 110° C. to 170° C., and more preferably 120° C. to 150° C.

In a second embodiment, the disclosure relates to a lubricating oil composition including greater than 50 wt % of a base oil, based on the total weight of the lubricating oil composition, and 0.1 wt % to 20 wt %, based on the total weight of the lubricating oil composition, of a dispersant viscosity modifier obtainable by:

A) forming a first reaction product by reacting:

a) at least one of a lactone of formula (I) or a derivative thereof:

(I)

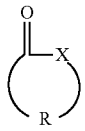

wherein X is oxygen, and R is an optionally substituted hydrocarbylene group having from 1 to 20 carbon atoms, wherein the hydrocarbylene group can be substituted with 1-3 substituents independently selected from halogen, hydroxyl, nitro, cyano, carboxy, and an alkyl or alkenyl group having 1 to 32 carbon atoms which may be linear or branched; and b) at least one compound selected from: a linear, branched cyclic or aromatic amine comprising at least one primary or secondary amino group; at least one primary, secondary, or tertiary alkyl alcohol or primary, secondary, or tertiary alkenyl alcohol; and an oxazoline;

B) forming a second reaction product by reacting:

c) at least one compound selected from: a linear, branched cyclic or aromatic amine comprising at least one primary or secondary amino group; at least one primary, secondary, or tertiary alkyl alcohol or primary, secondary, or tertiary alkenyl alcohol; and an oxazoline; and d) an acylated olefin copolymer obtainable by acylating a copolymer of ethylene and one or more $C_3$-$C_{10}$ alpha-olefins having a number average molecular weight (Mn) of 5,000 to 200,000 g/mol as measured by GPC, with an acylating agent; and C) reacting the first and the second reaction product of steps A) and B).

In this second embodiment, component b) may be same compounds as described above for component b) of the first embodiment.

In each of the foregoing second embodiments, component c) may include any one or more of the same compounds as described above for component b) of the first embodiment. Any combination of components b) and c) may be employed within the scope of the present disclosure and all possible combinations of components b) and c) are hereby disclosed for use in each of the foregoing embodiments.

In this second embodiment, component b) may be an amine, and component c) may be an amine. Alternatively, component b) may be an amine and component c) may be an alcohol. In a further embodiment, component b) may be an amine and component c) may be an oxazoline. Component c) may be an amine and component b) may be an alcohol. In a further embodiment, component c) may be an amine and component b) may be an oxazoline.

In each of the foregoing embodiments employing both components b) and c), components b) and c) may be N-phenyl-1,4-phenylenediamine, or component b) may be N-phenyl-1,4-phenylenediamine and component c) may be 1-napthalene methanol, or component b) may be N-phenyl-1,4-phenylenediamine and component c) may be dioctyl amine, or component b) may be N-phenyl-1,4-phenylenediamine and component c) may be 2-phenyl-2-oxazoline.

The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the lubricating oil composition excluding the major amount of base oil stock mixture. The additive package may or may not include the viscosity index improver or pour point depressant.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, and/or phenols.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, sulfoxy groups, pyridyl groups, furyl groups, thienyl groups, imidazolyl groups, sulfur, oxygen and nitrogen, and wherein no more than two non-hydrocarbon substituents are present for every ten carbon atoms in the hydrocarbyl group.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896 or ASTM D4739 or DIN 51639-1.

The term "alkyl" as employed herein refers to straight, branched, cyclic, and/or substituted saturated chain moieties of from about 1 to about 100 carbon atoms.

The term "alkenyl" as employed herein refers to straight, branched, cyclic, and/or substituted unsaturated chain moieties of from about 3 to about 10 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

Lubricants, combinations of components, or individual components of the present description may be suitable for use in various types of internal combustion engines. Suitable engine types may include, but are not limited to heavy duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression ignited engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines.

The internal combustion engine may contain components of one or more of an aluminum-alloy, lead, tin, copper, cast iron, magnesium, ceramics, stainless steel, composites, and/or mixtures thereof. The components may be coated, for example, with a diamond-like carbon coating, a lubrited coating, a phosphorus-containing coating, molybdenum-containing coating, a graphite coating, a nano-particle-containing coating, and/or mixtures thereof. The aluminum-alloy may include aluminum silicates, aluminum oxides, or other ceramic materials. In one embodiment the aluminum-alloy is an aluminum-silicate surface. As used herein, the term "aluminum alloy" is intended to be synonymous with "aluminum composite" and to describe a component or surface comprising aluminum and another component intermixed or reacted on a microscopic or nearly microscopic level, regardless of the detailed structure thereof. This would include any conventional alloys with metals other than aluminum as well as composite or alloy-like structures with non-metallic elements or compounds such with ceramic-like materials. In some embodiments, the lubricating oil composition is adapted for use as a crankcase engine oil lubricant suitable for lubrication of at least pistons, rings, cylinders, bearings and crankshafts of an engine crankcase.

The lubricating oil composition for an internal combustion engine may be suitable for any engine lubricant irrespective of the sulfur, phosphorus, or sulfated ash (ASTM D-874) content. The sulfur content of the engine oil lubricant may be about 1 wt % or less, or about 0.8 wt % or less, or about 0.5 wt % or less, or about 0.3 wt % or less, or about 0.2 wt % or less. In one embodiment the sulfur content may be in the range of about 0.001 wt % to about 0.5 wt %, or about 0.01 wt % to about 0.3 wt %. The phosphorus content may be about 0.2 wt % or less, or about 0.1 wt % or less, or about 0.085 wt % or less, or about 0.08 wt % or less, or even about 0.06 wt % or less, about 0.055 wt % or less, or about 0.05 wt % or less. In one embodiment the phosphorus content may be about 50 ppm to about 1000 ppm, or about 325 ppm to about 850 ppm. The total sulfated ash content may be about 2 wt % or less, or about 1.5 wt % or less, or about 1.1 wt % or less, or about 1 wt % or less, or about 0.8 wt % or less, or about 0.5 wt % or less. In one embodiment the sulfated ash content may be about 0.05 wt % to about 0.9 wt %, or about 0.1 wt % or about 0.2 wt % to about 0.45 wt %. In another embodiment, the sulfur content may be about 0.4 wt % or less, the phosphorus content may be about 0.08 wt % or less, and the sulfated ash is about 1 wt % or less. In yet another embodiment the sulfur content may be about 0.3 wt % or less, the phosphorus content is about 0.05 wt % or less, and the sulfated ash may be about 0.8 wt % or less.

In one embodiment the lubricating oil composition is an engine oil, wherein the lubricating oil composition may have (i) a sulfur content of about 0.5 wt % or less, (ii) a phosphorus content of about 0.1 wt % or less, and (iii) a sulfated ash content of about 1.5 wt % or less.

In one embodiment the lubricating oil composition is suitable for a 2-stroke or a 4-stroke marine diesel internal combustion engine. In one embodiment the marine diesel combustion engine is a 2-stroke engine. In some embodiments, the lubricating oil composition is not suitable for a 2-stroke or a 4-stroke marine diesel internal combustion engine for one or more reasons, including but not limited to, the high sulfur content of fuel used in powering a marine engine and the high TBN required for a marine-suitable engine oil (e.g., above about 40 TBN in a marine-suitable engine oil).

In some embodiments, the lubricating oil composition is suitable for use with engines powered by low sulfur fuels, such as fuels containing about 1 to about 5% sulfur. Highway vehicle fuels contain about 15 ppm sulfur (or about 0.0015% sulfur).

Low speed diesel typically refers to marine engines, medium speed diesel typically refers to locomotives, and high speed diesel typically refers to highway vehicles. The lubricating oil composition may be suitable for only one of these types or all.

Further, lubricants of the present description may be suitable to meet one or more industry specification requirements such as ILSAC GF-3, GF-4, GF-5, GF-5+, GF-6, PC-11, CF, CF-4, CH-4, CI-4, CJ-4, API SG, SJ, SL, SM, SN, SN+, ACEA A1/B1, A2/B2, A3/B3, A3/B4, A5/B5, C1, C2, C3, C4, C5, E4/E6/E7/E9, Euro 5/6, Jaso DL-1, Low SAPS, Mid SAPS, or original equipment manufacturer specifications such as Dexos™ 1, Dexos™ 2, MB-Approval 229.1, 229.3, 229.5, 229.31, 229.51, 229.52, 229.6, 229.71, 226.5, 226.51, 228.0/.1, 228.2/.3, 228.31, 228.5, 228.51, 228.61, VW 501.01, 502.00, 503.00/503.01, 504.00, 505.00, 505.01, 506.00/506.01, 507.00, 508.00, 509.00, 508.88, 509.99, BMW Longlife-01, Longlife-01 FE, Longlife-04, Longlife-12 FE, Longlife-14 FE+, Porsche A40, C30, Peugeot Citroen Automobiles B71 2290, B71 2294, B71 2295, B71 2296, B71 2297, B71 2300, B71 2302, B71 2312, B71 2007, B71 2008, Renault RN0700, RN0710, RN0720, Ford WSS-M2C153-H, WSS-M2C930-A, WSS-M2C945-A, WSS-M2C913A, WSS-M2C913-B, WSS-M2C913-C, WSS-M2C913-D, WSS-M2C948-B, WSS-M2C948-A, GM 6094-M, Chrysler MS-6395, Fiat 9.55535 G1, G2, M2, N1, N2, Z2, S1, S2, S3, S4, T2, DS1, DSX, GH2, GS1, GSX, CR1, Jaguar Land Rover STJLR.03.5003, STJLR.03.5004, STJLR.03.5005, STJLR.03.5006, STJLR.03.5007, STJLR.51.5122, or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

Other hardware may not be suitable for use with the disclosed lubricant. A "functional fluid" is a term which encompasses a variety of fluids including but not limited to tractor hydraulic fluids, power transmission fluids including automatic transmission fluids, continuously variable transmission fluids and manual transmission fluids, hydraulic fluids, including tractor hydraulic fluids, some gear oils, power steering fluids, fluids used in wind turbines, compressors, some industrial fluids, and fluids related to power train components. It should be noted that within each of these fluids such as, for example, automatic transmission fluids, there are a variety of different types of fluids due to the various uses which have led to the need for fluids of markedly different functional characteristics. This is contrasted by the term "lubricating fluid" which is not used to generate or transfer power.

When the functional fluid is an automatic transmission fluid, the automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail. This is not a function of an engine oil.

Each of these fluids, whether functional, tractor, or lubricating, are designed to meet specific and stringent manufacturer requirements. Thus, not all lubricants can function in each of these different applications. See e.g. Mortier et al. "Chemistry and Technology of Lubricants", Blackie Academic and Professional, Second Edition, pp. 203-205 (1997).

The present disclosure provides novel lubricating oil blends formulated for use as automotive crankcase lubricants. The present disclosure provides novel lubricating oil blends formulated for use as 2T and/or 4T motorcycle crankcase lubricants. Embodiments of the present disclosure may provide lubricating oils suitable for crankcase applications may have improvements in the following characteristics: air entrainment, alcohol fuel compatibility, low temperature properties, antioxidancy, antiwear performance, biofuel compatibility, foam reducing properties, friction reduction, fuel economy, preignition prevention, rust inhibition, sludge and/or soot dispersability, piston cleanliness, deposit formation, and water tolerance.

Engine oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil (or a mixture of both). The fully formulated engine oil may exhibit improved performance properties, based on the additives added and their respective proportions.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1:
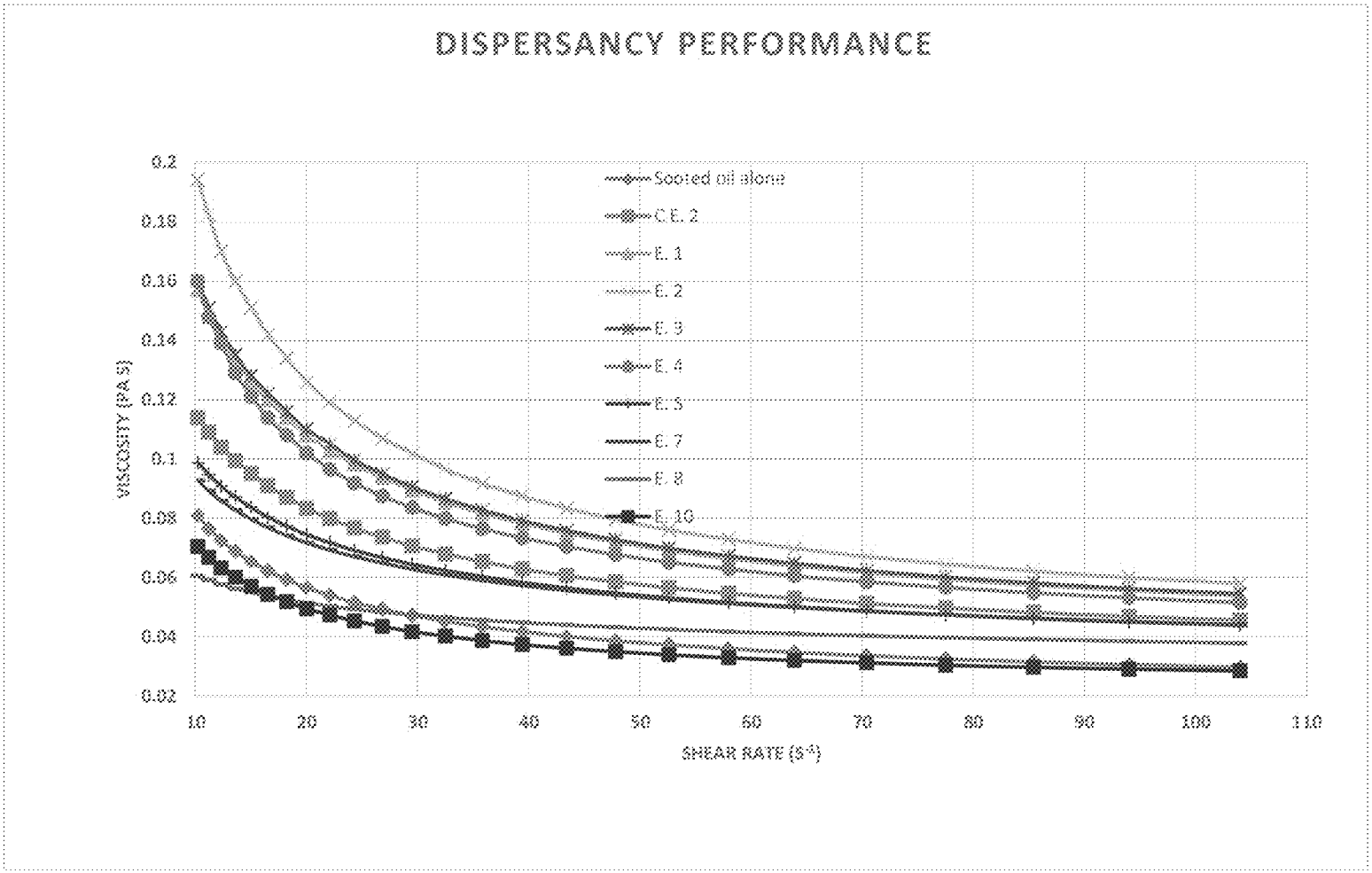
FIG. 1 is a graph showing dispersancy performance of lubricating oil compositions of the present invention in terms of the viscosity of the lubricating oil composition versus the shear rate.

Disclosed herein is a lubricating oil composition including: greater than 50 wt % of a base oil, based on the total weight of the lubricating oil composition, and 0.1 wt % to 20 wt %, based on the total weight of the lubricating oil composition, of a dispersant viscosity modifier.

Base Oil

The base oil used in the lubricating oil compositions herein may be selected from any of the base oils in Groups I-V as specified in the American Petroleum Institute (API) Base Oil Interchangeability Guidelines. The five base oil groups are as follows:

TABLE 1

| Base oil Category | Sulfur (wt %) | | Saturates (wt %) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥1.20 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained in a manner similar to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or dispersant viscosity index improvers in the composition.

In another embodiment, the major amount of base oil included in a lubricating composition may be selected from the group consisting of Group II base oil having at least 90 wt % saturates, a Group III base oil having at least 90 wt % saturates, a Group IV, a Group V, and a combination of two or more of the foregoing, and wherein the major amount of base oil is other than base oils that arise from provision of additive components or dispersant viscosity index improvers in the composition.

The amount of the oil of lubricating viscosity in a finished fluid may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

The Dispersant Viscosity Modifier

In one embodiment, the dispersant viscosity modifier of the disclosure is made by:

A) forming a reaction product by reacting:

a) at least one of a lactone of formula (I) or a derivative thereof:

(I)

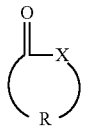

wherein X is oxygen, and R is an optionally substituted hydrocarbylene group having from 1 to 20 carbon atoms, wherein the hydrocarbylene group can be substituted with 1-3 substituents independently selected from halogen, hydroxyl, nitro, cyano, carboxy, and an alkyl or alkenyl group having 1 to 32 carbon atoms which may be linear or branched; and b) at least one compound selected from:

a linear, branched cyclic or aromatic amine comprising at least one primary or secondary amino group; at least one primary, secondary, or tertiary alkyl alcohol or primary, secondary, or tertiary alkenyl alcohol; and an oxazoline; and B) reacting the reaction product of step A) onto an acylated olefin copolymer obtainable by acylating a copolymer of ethylene and one or more $C_3$-$C_{10}$ alpha-olefins having a number average molecular weight (Mn) of 5,000 to 200,000 g/mol as measured by GPC, with an acylating agent.

The following schematic depicts an exemplary embodiment of a suitable process for making a dispersant viscosity modifier in accordance with the first aspect of the disclosure:

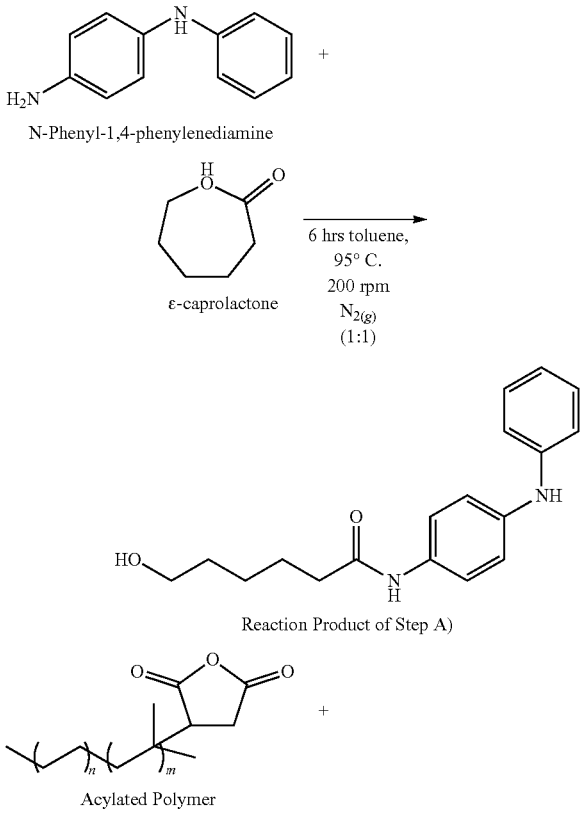

-continued

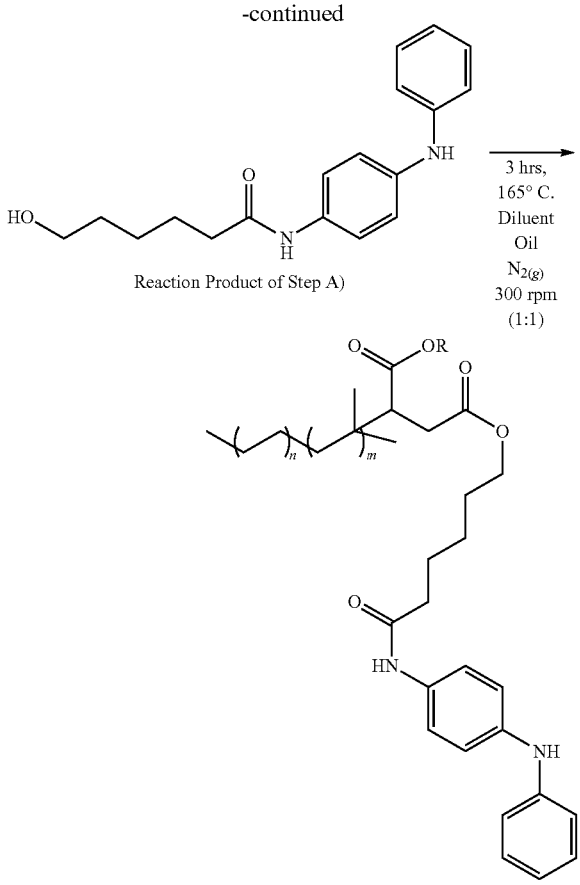

The Reaction Product of Step A)

In step A) of the reaction to prepare the dispersant viscosity modifier, the lactone or lactone derivative and component b) may be mixed in a suitable solvent, and heated it to at least 95° C. or from 95° C. to 170° C. Generally, stirring at 200 rpm under active nitrogen flow for 6 hrs is sufficient to complete the reaction. The amount of component b) reacted with the lactone or lactone derivative is at least about one molar equivalent of the lactone or lactone derivative per molar equivalent of amine (based on amino nitrogen), hydroxy group or oxazoline group, or a ratio of from about 1:1 to about 2:1 molar equivalents of the lactone or lactone derivative per molar equivalent of amine, hydroxy group or oxazoline group.

The schematic below depicts an exemplary embodiment of step A) of the synthesis of the dispersant viscosity modifiers of the present disclosure. The reactants employed in step A) of this exemplary embodiment were E-caprolactone, and N-phenyl-p-phenylenediamine (NPPDA). The lactone and amine are reacted as follows to form the reaction product of step A):

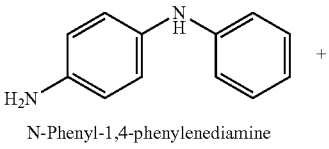

-continued

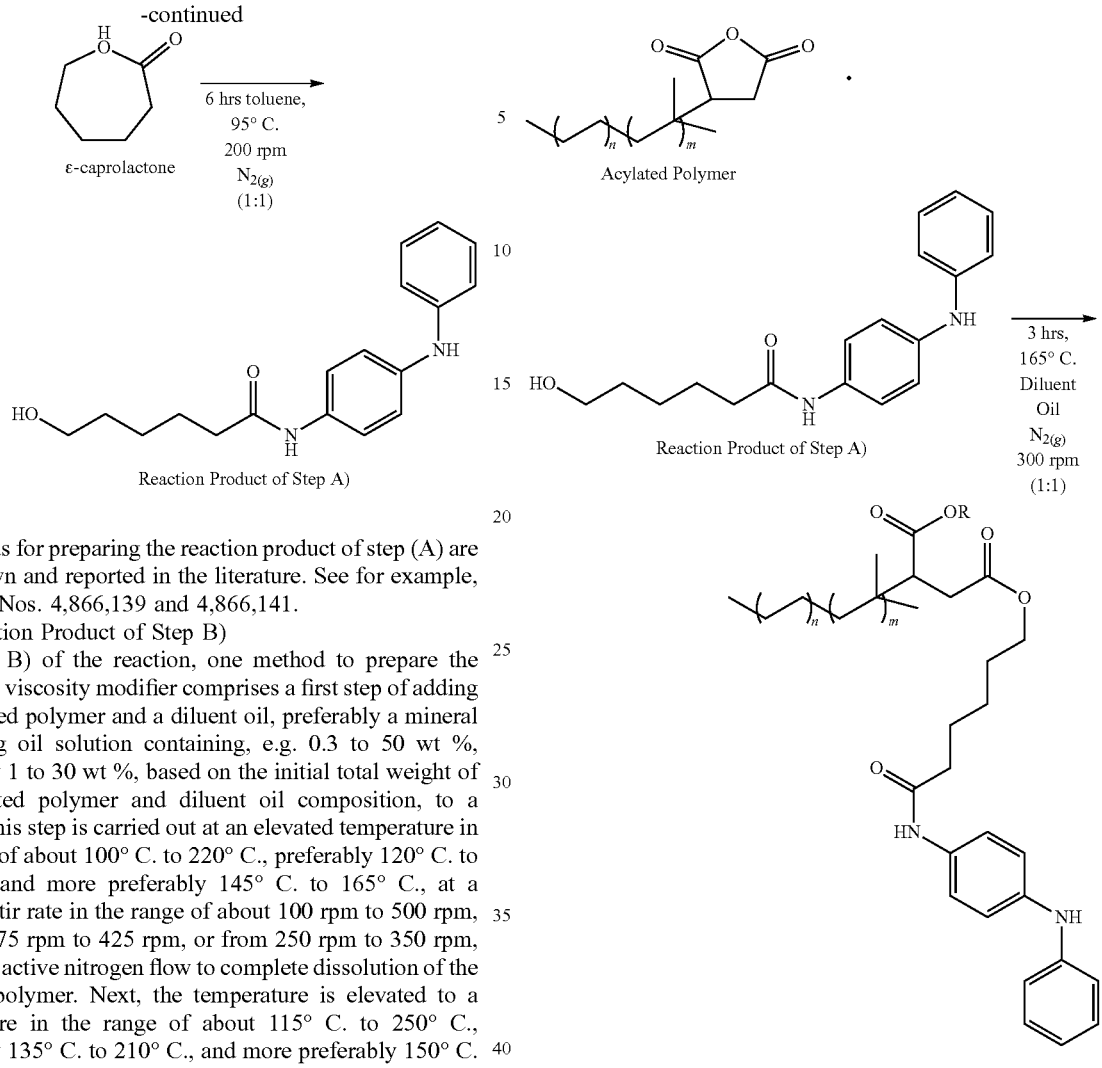

Methods for preparing the reaction product of step (A) are well known and reported in the literature. See for example, U.S. Pat. Nos. 4,866,139 and 4,866,141.

The Reaction Product of Step B)

In step B) of the reaction, one method to prepare the dispersant viscosity modifier comprises a first step of adding the acylated polymer and a diluent oil, preferably a mineral lubricating oil solution containing, e.g. 0.3 to 50 wt %, preferably 1 to 30 wt %, based on the initial total weight of the acylated polymer and diluent oil composition, to a reactor. This step is carried out at an elevated temperature in the range of about 100° C. to 220° C., preferably 120° C. to 180° C., and more preferably 145° C. to 165° C., at a constant stir rate in the range of about 100 rpm to 500 rpm, or from 175 rpm to 425 rpm, or from 250 rpm to 350 rpm, and under active nitrogen flow to complete dissolution of the acylated polymer. Next, the temperature is elevated to a temperature in the range of about 115° C. to 250° C., preferably 135° C. to 210° C., and more preferably 150° C. to 170° C., at a constant stir rate in the range of about 100 rpm to 500 rpm, preferably 175 rpm to 425 rpm, and more preferably 250 rpm to 350 rpm, and the reaction product of step A) is added to the reaction mixture and reacted for 2 hrs to 15 hrs, preferably 3 hrs to 12 hrs, more preferably from 4 hrs to 8 hrs and under constant nitrogen flow. Next, the mixture is allowed to cool to a temperature in the range of about 100° C. to 200° C., preferably 110° C. to 170° C., and more preferably 120° C. to 150° C. Finally, the product is allowed to cool to room temperature.

The ratio of moles of reaction product of step A) per moles of carboxyl groups of the acylated polymer is from 0.25:1 to 4:1 or from 0.5:1 to 2:1, or more preferably from 0.5:1 to 1:1, or at 0.5:1.

The amount of reaction product of step A) reacted with the acylated polymer, wherein the reaction product of step A) comprises a primary alcohol group is approximately one mole of alcohol groups per two carboxyl groups of the acylated polymer, approximately 1:2 to reactive moieties. The diluent oil may be selected from a Group I base oil.

The schematic below depicts an exemplary embodiment of step B) of the synthesis of the dispersant viscosity modifiers of the present disclosure. The reactants employed in step B) of this exemplary embodiment were an acylated ethylene-propylene copolymer and a reaction product of step A) prepared from NPPDA and ε-caprolactone.

In an alternative method for step B), the reaction of the dissolved acylated copolymer with the product of step A) is carried out at a temperature in the range of about 115° C. to 250° C., preferably 135° C. to 210° C., and more preferably 150° C. to 170° C., at a constant stir rate in the range of about 100 rpm to 500 rpm, preferably 175 rpm to 425 rpm, and more preferably 250 rpm to 350 rpm, and the reaction product of step A) is added to the reaction mixture under constant nitrogen flow for at least 1 hr to 5 hrs, preferably 2 hrs to 4 hrs. Next, component c) is added to the reaction mixture and the temperature maintained from the previous step. Finally, the reaction mixture is allowed to cool to a temperature in the range of about 100° C. to 200° C., preferably 110° C. to 170° C., and more preferably 120° C. to 150° C. Finally, the product is allowed to cool to room temperature. Component c) is at least one compound selected from a linear, branched, cyclic, or aromatic amine including at least one primary or secondary amino group; at least one primary, secondary, or tertiary alkyl alcohol or primary, secondary, or tertiary alkenyl alcohol; and an oxazoline.

The ratio of moles of reaction product of step A) per mole of carboxyl groups of the acylated polymer is from 0.25:1 to 4:1 or from 0.5:1 to 2:1, or more preferably 0.5:1. The amount of reaction product of step A) reacted with the acylated polymer, wherein the reaction product of step A) comprises a primary alcohol group is approximately one mole of alcohol groups per two carboxyl groups of the acylated polymer, approximately 1:2 to reactive moieties The ratio of moles of reaction product of step A) per mole of carboxyl groups of the acylated polymer is from 0.25:1 to 4:1 or from 0.5:1 to 2:1, or more preferably 0.5:1.

In a further alternative embodiment, the dispersant viscosity modifier of the disclosure may be made by:

A) forming a first reaction product by reacting the reaction product of a lactone or a lactone derivative and component b), wherein component b) is selected from a linear, branched cyclic or aromatic amine comprising at least one primary or secondary amino group, at least one primary, secondary, or tertiary alkyl alcohol or primary, secondary, or tertiary alkenyl alcohol, and an oxazoline, and B) forming a second reaction product, by reacting component c), wherein component c) is at least one compound selected from: a linear, branched cyclic or aromatic amine comprising at least one primary or secondary amino group, at least one primary, secondary, or tertiary alkyl alcohol or primary, secondary, or tertiary alkenyl alcohol, and an oxazoline; and an olefin copolymer comprising ethylene and one or more $C_3$-$C_{10}$ alpha olefins with an acylating agent and C) reacting the first and second reaction products of steps A) and B).

In each of the foregoing processes, the acylated olefin copolymer may be further reacted with a component c) prior to reacting with the reaction product of step A), wherein component c) is at least one compound selected from: a linear, branched cyclic or aromatic amine comprising at least one primary or secondary amino group; at least one primary, secondary, or tertiary alkyl alcohol or primary, secondary, or tertiary alkenyl alcohol; and an oxazoline. The reaction of the acylated olefin copolymer and component c) may be carried out at a temperature of from 115° C. to 250° C., preferably 135° C. to 210° C., and more preferably 150° C. to 170° C., for 1 to 5 hours, preferably 2 hrs to 4 hrs, and step B) is carried out at a temperature of from 115° C. to 250° C., preferably 135° C. to 210° C., and more preferably 150° C. to 170° C. The reaction of the acylated olefin copolymer and component c) may be carried out at a constant stir rate in the range of about 100 rpm to 500 rpm, preferably 175 rpm to 425 rpm, and more preferably 250 rpm to 350 rpm, and the reaction product of step A) is added to the reaction mixture and reacted for 2 hrs to 15 hrs, preferably 3 hrs to 12 hrs, more preferably from 4 hrs to 8 hrs and under constant nitrogen flow. Next, the mixture is allowed to cool to a temperature in the range of about 100° C. to 200° C., preferably 110° C. to 170° C., and more preferably 120° C. to 150° C.

The Reaction Product of Step A)

In step A) of the reaction to prepare the dispersant viscosity modifier, the lactone or lactone derivative and component b) are mixed in a suitable solvent, and heated to at least 95° C. or from 95° C. to 170° C. Generally, stirring at 200 rpm under active nitrogen flow for 6 hrs is sufficient to complete the reaction. The amount of amine reacted with the lactone or lactone derivative is at least about one molar equivalent of the lactone or lactone derivative per molar equivalent of amine (based on amino nitrogen) or a ratio of from about 1:1 to about 2:1 molar equivalents of the lactone or lactone derivative per molar equivalent of amine. The schematic below depicts an exemplary embodiment of step A) of the synthesis of the dispersant viscosity modifiers of the present disclosure. The reactants employed in step A) of this exemplary embodiment were E-caprolactone, and N-Phenyl-p-phenylenediamine (NPPDA). The lactone and amine are reacted as follows to form the reaction product of step A):

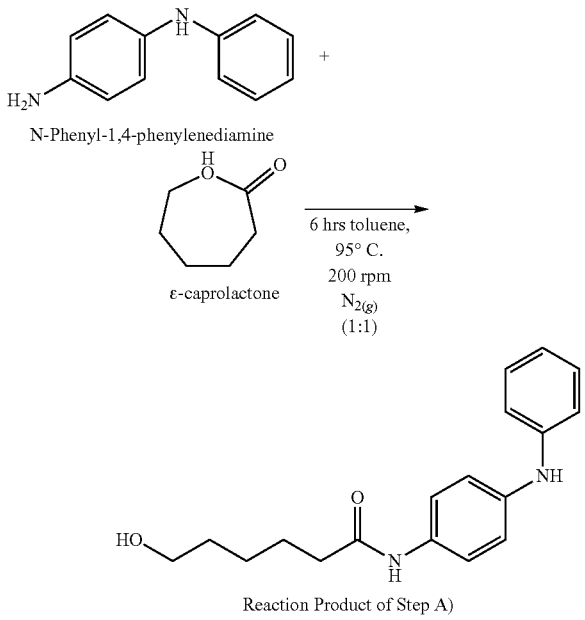

Methods for preparing the reaction product of step (A) are well known and reported in the literature. See for example, U.S. Pat. Nos. 4,866,139 and 4,866,141.

Reaction with Both of Components b) and c)

In a second embodiment, the dispersant viscosity modifier is obtainable by:

A) forming a first reaction product by reacting:

a) at least one of a lactone of formula (I) or a derivative thereof:

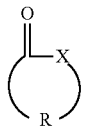

(I)

wherein X is oxygen, and R is an optionally substituted hydrocarbylene group having from 1 to 20 carbon atoms, wherein the hydrocarbylene group can be substituted with 1-3 substituents independently selected from halogen, hydroxyl, nitro, cyano, carboxy, and an alkyl or alkenyl group having 1 to 32 carbon atoms which may be linear or branched; and b) at least one compound selected from: a linear, branched cyclic or aromatic amine comprising at least one primary or secondary amino group; at least one primary, secondary, or tertiary alkyl alcohol or primary, secondary, or tertiary alkenyl alcohol; and an oxazoline;

B) forming a second reaction product by reacting:

c) at least one compound selected from: a linear, branched cyclic or aromatic amine comprising at least one primary or secondary amino group; at least one primary, secondary, or tertiary alkyl alcohol or primary, secondary, or tertiary alkenyl alcohol; and an oxazoline; and d) an acylated olefin copolymer obtainable by acylating a copolymer of ethylene and one or more $C_3$-$C_{10}$ alpha-olefins having a number average molecular weight (Mn) of 5,000 to 200,000 g/mol as measured by GPC, with an acylating agent; and C) reacting the first and the second reaction product of steps A) and B).

The Reaction Products of Steps B) and C)

In the second method for preparing the dispersant viscosity modifier, in carrying out step B) of the reaction, the dispersant viscosity modifier may be prepared by adding component c) to the dissolved acylated copolymer. In this process, the temperature of the dissolved acylated copolymer is elevated to a temperature in the range of about 115° C. to 250° C., preferably 135° C. to 210° C., and more preferably 150° C. to 170° C., at a constant stir rate in the range of about 100 rpm to 500 rpm, preferably 175 rpm to 425 rpm, and more preferably 250 rpm to 350 rpm, and component c) is added to the reaction mixture and allowed to react for at least 1 hr. to 5 hrs, preferably 2 hrs to 4 hrs, and under constant nitrogen flow. Next, the reaction product of step A) is added to the reaction mixture and reacted for 2 hrs to 15 hrs, preferably 3 hrs to 12 hrs, more preferably from 4 hrs to 8 hrs, and then allowed to cool to a temperature in the range of about 100° C. to 200° C., preferably 110° C. to 170° C., and more preferably 120° C. to 150° C. Finally, the product is allowed to cool to room temperature. Component c) may be selected from an amine, an alcohol, and oxazoline, as set forth above.

The ratio of moles of reaction product of step A) per mole of carboxyl groups of the acylated polymer is from 0.25:1 to 4:1 or from 0.5:1 to 2:1 or from 0.5:1 to 1:1, or more preferably at 0.5:1. The amount of reaction product of step A) reacted with the acylated polymer, wherein the reaction product of step A) comprises a primary alcohol group is approximately one mole of alcohol groups per two carboxyl groups of the acylated polymer, approximately 1:2 to reactive moieties. Step B) of the method may employ a molar ratio of the moles of reaction product of step A) to the moles of component c) in the range of from 0.25:1 to 4:1 or from 0.5:1 to 2:1 or from 0.5:1 to 1:1, or at 0.5:1.

The dispersant viscosity modifier may be present in the lubricating oil composition in an amount of from about 0.1 wt % to about 20 wt %, based on the total weight of the engine oil composition. In another embodiment, the dispersant viscosity modifier is present in the lubricating oil composition in an amount of from about 0.1 wt % to about 10 wt %, or from about 0.1 wt % to about 5 wt %, based on the total weight of the lubricating oil composition. In a preferred embodiment, the dispersant viscosity modifier is present in the engine oil composition in an amount of about 0.5 wt % to about 8 wt %, or from about 1 wt % to 5 wt % based on the total weight of the lubricating oil composition.

Lactones

The lactones employed in the present disclosure may include epsilon, delta, gamma, omega lactones represented by the formula (I):

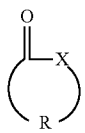

(I)

wherein X is oxygen, R is an optionally substituted hydrocarbylene group having from 1 to 20 carbon atoms, and the hydrocarbylene group can be substituted with 1-3 substituents independently selected from halogen, hydroxyl, nitro, cyano, carboxy, and an alkyl or alkenyl group having 1 to 32 carbon atoms which may be linear or branched. The preferred lactones have no more than two substituted groups.

In other embodiments, R is an optionally substituted hydrocarbylene group having from 3 to 18 carbon atoms, or from 4 to 16 carbon atoms.

Non-limiting examples of suitable lactones of the present disclosure include acetolactone, propiolactone, butyrolactone, valerolactone, caprolactone, δ-valerolactone, methyl-δ-valero-lactone, methyl-ε-caprolactone, dimethyl-ε-caprolactone, methoxy-ε-caprolactone, cyclohexyl-ε-caprolactone, methylbenzyl-ε-caprolactone, caprylolactone, methyl-caprylolactone, trimethylene carbonate, valerolactone, β-methyl-δ-valerolactone, 4-membered cyclic lactones such as β-propiolactone, β-methylpropiolactone, L-serine-β-lactone; 5-membered cyclic lactones such as γ-butyrolactone, γ-hexanolactone, γ-heptanolactone, γ-octanolactone, γ-decanolactone, γ-dodecanolactone, α-hexyl-γ-butyrolactone, α-heptyl-γ-butyrolactone, α-hydroxy-γ-butyrolactone, γ-methyl-γ-decanolactone, α-methylene-γ-butyrolactone, α,α-dimethyl-γ-butyrolactone, D-erythronolactone, α-methyl-γ-butyrolactone, γ-nonanolactone, DL-pantolactone, γ-phenyl-γ-butyrolactone, γ-undecanolactone, 2,2-pentamethylene-1,3-dioxolan-4-one, α-bromo-γ-butylolactone, γ-crotonolactone, α-methylene-γ-butylolactone, α-methacryloyloxy-γ-butyrolactone, β-methacryloyloxy-γ-butyrolactone; δ-membered cyclic lactones such as, δ-hexanolactone, δ-octanolactone, δ-nonanolactone, δ-decanolactone, δ-undecanolactone, δ-dodecanolactone, δ-tridecanolactone, δ-tetradecanolactone, DL-mevalonolactone, 4-hydroxy-1-cyclohexanecarboxylic acid δ-lactone; 7-membered cyclic lactones such as ε-caprolactone; and D-glucono-1,5-lactone.

Preferably, the lactone is selected from ε-caprolactone, undecanoic-δ-lactone, undecanoic-γ-lactone, γ-octanoiclactone, ω-pentadecalactone. In another embodiment, the ε-caprolactone is particularly preferred.

Lactone derivatives can also be employed in the process of the present disclosure. Suitable lactone derivatives may include, but are not limited to, hydrolysis products of the lactones described above. Non-limiting examples of lactone derivatives include hydroxycarboxylic acids such as 4-hydroxybutyric acid, 3-hydroxyvaleric acid, 4-hydroxyvaleric acid, 5-hydroxyvaleric acid, dimethylglycolic acid, β-hydroxypropanic acid, α-hydroxybutyric acid, α-hydroxycaproic acid, (3-hydroxycaproic acid, γ-hydroxycaproic acid, δ-hydroxycaproic acid, δ-hydroxymethylcaproic acid, ε-hydroxycaproic acid, ε-hydroxymethylcaproic acid), 5-hydroxypentanoic acid, glycolic acid, 2-hydroxypropanoic acid, 3-hydroxypropanoic acid, 2-hydroxyvaleric acid, 2-hydroxycaproic acid, 3-hydroxycaproic acid, 4-hydroxycaproic acid, 5-hydroxycaproic acid, 6-hydroxycaproic acid, 6-hydroxymethyl caproic acid, and mandelic acid; lactides, 1,5-dioxepan-2-one, 1,6-dioxaspiro-4,4 nonane-2,7-dione, 4-methyl-3-(1-pyrrolidinyl)-2[5H]-furanone, (5R)-5-[(1S)-1,2-dihydroxyethyl]-3,4-dihydroxyfuran-2(5H)-one, 3a,4,5,7a-tetrahydro-3,6-dimethylbenzofuran-2(3H)-one, 5-methylpentanolide, 5-propylpentanolide, 5-butylpentanolide, 5-pentylpentanolide, 5-hexylpentanolide, 5-heptylpentanolide, 5-pentylpent-2-en-5-olide, Z-2-pentenylpentan-5-olide, and 5-pentylpenta-2,4-dien-5-olide.

Components b) and c)

Components b) and c) are each independently selected from a linear, branched, cyclic, or aromatic amine comprising at least one primary or secondary amino group, at least one primary, secondary, or tertiary alkyl alcohol or primary, secondary, or tertiary alkenyl alcohol, and an oxazoline. Suitable amines, alcohols, and oxazolines for both of components b) and c) are set forth below.

Amines

The amines employed in the present disclosure are linear, branched, cyclic or aromatic amines comprising at least one primary or secondary amino group. Examples of suitable amines for use in the present disclosure include the following compounds:

(i) an N-arylphenylenediamine represented by the following formula (II):

(II)

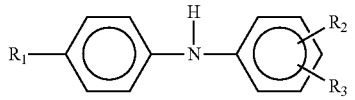

wherein $R_1$ is hydrogen, —NH-aryl, —NH-arylalkyl, —NH-alkyl or a branched or straight chain radical having from 4 to 24 carbon atoms selected from alkyl, alkenyl, alkoxyl, aralkyl, alkaryl, hydroxyalkyl and aminoalkyl; $R_2$ is —$NH_2$, $CH_2$—$(CH_2)_n$—$NH_2$, or $CH_2$-aryl-$NH_2$, in which n has a value from 1 to 10; and $R_3$ is selected from hydrogen, alkyl, alkenyl, alkoxyl, aralkyl, and alkaryl having from 4 to 24 carbon atoms.

(ii) an aminothiazole selected from the group consisting of aminothiazole, aminobenzothiazole, aminobenzo-thiadizole and aminoalkylthiazole, aminobenzo-thiadiazole and aminoalkylthiazole.

(iii) an aminocarbazole represented by the formula:

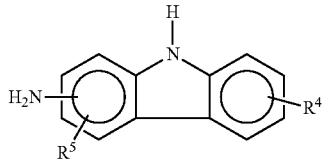

wherein $R^4$ and $R^5$ represent hydrogen or an alkyl, alkenyl, or alkoxyl radical having from 1 to 14 carbon atoms;

(iv) an aminoindole represented by the formula:

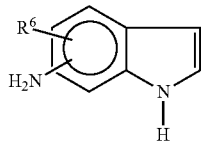

wherein $R^6$ represents hydrogen or an alkyl radical having from 1 to 14 carbon atoms;

(v) an aminopyrrole represented by the formula:

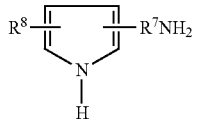

wherein $R^7$ is a divalent alkylene radical having 2-6 carbon atoms and $R^8$ is hydrogen or an alkyl radical having from 1 to 14 carbon atoms;

(vi) an amino-indazolinone represented by the formula:

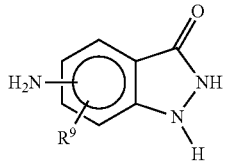

wherein $R^9$ is hydrogen or an alkyl radical having from 1 to 14 carbon atoms;

(vii) an aminomercaptotriazole represented by the formula:

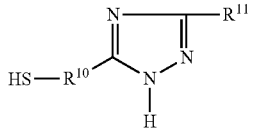

wherein $R^{10}$ can be absent or is a $C_1$-$C_{10}$ linear or branched hydrocarbylene selected from the group consisting of alkylene, alkenylene, arylalkylene, or arylene; and $R^{13}$ is hydrogen or a $C_1$-$C_{14}$ alkyl, alkenyl, aralkyl or aryl group;

(viii) an aminoperimidine represented by the formula,

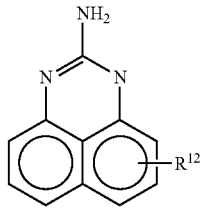

wherein $R^{12}$ represents hydrogen or an alkyl or alkoxy radical having from 1 to 14 carbon atoms;

(ix) aminoalkyl imidazoles such as 1-(2-aminoethyl) imidazole, 1-(3-aninopropyl) imidazole; and/or (x) aminoalkyl morpholines such as 4-(3 aminopropyl) morpholine.

Particularly preferred amines for use in the present disclosure are the N-arylphenylenediamines, more specifically the N-phenylphenylenediamines, for example, N-phenyl-1, 4-phenylenediamine, N-phenyl-1,3-phenylenediamine, and N-phenyl-1,2-phenylenediamine.

Preferred amines comprise a $C_2$-$C_{17}$ alkyl or alkenyl group. In the case of secondary amines, the preferred amines are branched amines having one or two $C_8$-$C_{18}$ alkyl or alkenyl groups attached to the beta carbon atom. Suitable secondary amines may be selected from dibutylamine, diisobutylamine, di-tert-butylamine, dipentylamine, dihexylamine, diheptylamine, dioctylamine, di(2-ethylhexylamine), dinonylamine and didecylamine, and also N-methylcyclohexylamine, N-ethylcyclohexylamine and dicyclohexylamine. Preferably, the secondary amine is dioctylamine.

Alcohols

The alcohols employed in the present disclosure include at least one primary, secondary, or tertiary alkyl alcohol or primary, secondary, or tertiary alkenyl alcohol. Preferably, the alcohols comprise 8 to 32 carbon atoms with branching at the α carbon, or the β carbon, or the γ carbon, or the δ carbon, or the ε carbon, or mixtures thereof, relative to the oxygen of the hydroxyl group of the alcohol.

For example, an alcohol with branching at the alpha (α) carbon, would be branched at the carbon atom directly bonded to the oxygen atom of the hydroxyl group. Branching at the beta (β) carbon, would be branching at the second carbon counted from the oxygen atom of the hydroxyl group, branching at the gamma (γ) carbon, would be branching at the third carbon counted from the oxygen atom of the hydroxyl group, branching at the delta (δ) carbon would be branching at the fourth carbon counted from the oxygen atom of the hydroxyl group and branching at the epsilon (ε) carbon, would be branching at the fifth carbon counted from the oxygen atom of the hydroxyl group.

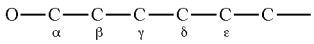

Specifically, preferred alcohols for the present disclosure may be represented by the formulae (III) and (IV). Formula (III) represents suitable primary and secondary alkyl or alkenyl alcohols of the present disclosure:

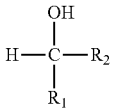

(III)

wherein $R_1$ is selected from a hydrogen and an optionally substituted linear or branched alkyl or alkenyl group, and $R_2$ is an optionally substituted linear or branched alkyl or alkenyl group wherein the number of carbon atoms of $R_1$ and $R_2$ add to a total of 7 to 31 carbon atoms. Preferably, $R_1$ is a hydrogen and $R_2$ is an optionally substituted alkyl or alkenyl group. More preferably, $R_1$ is a hydrogen and $R_2$ is an optionally substituted linear alkyl or alkenyl group having from 7 to 31 carbon atoms, or from 7 to 30 carbon atoms, or from 8 to 30 carbon atoms, and wherein the carbon of said linear alkyl or alkenyl group which is bonded to the alpha carbon is also bonded to two other carbons in said linear alkyl or alkenyl group. Preferably, the alcohol compound of Formula (I) comprises an alkyl or alkenyl group having a branch at the β carbon, relative to the oxygen atom. Exemplary beta branched alcohols include, but are not limited to, 2-ethylhexanol, 2-butyloctanol, isomyristyl alcohol, 2-hexyldecanol, isostearyl alcohol, 2-octyldodecanol, 2-decyltetradecanol, 2-dodecylhexadecanol, and 2-tetradecyloctadecanol.

In another aspect, $R_1$ and $R_2$ are alkyl or alkenyl groups, wherein at least one of the alkyl or alkenyl groups of $R_1$ and $R_2$ is linear and comprises 6-30 carbon atoms.

In each of the foregoing embodiments, Formula (III) can comprise at least one branched alkyl or alkenyl group, wherein the location of the branching is selected from the group consisting of the β carbon, the γ carbon, the δ carbon, the ε carbon, and mixtures thereof, relative to the oxygen.

Suitable tertiary alcohols may be represented by Formula (IV):

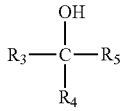

(IV)

wherein $R_3$, $R_4$, and $R_5$ are independently selected from an optionally substituted linear or branched alkyl or alkenyl group wherein the number of carbon atoms of $R_3$, $R_4$ and $R_5$ add to a total of 7 to 31 carbon atoms. Preferably, at least one of $R_3$, $R_4$, and $R_5$ is an optionally substituted linear alkyl or alkenyl group wherein the carbon of said linear alkyl or alkenyl group which is bonded to the alpha carbon is also bonded to two other carbons in said linear alkyl or alkenyl group. Preferably, the alcohol compound of Formula (IV) comprises an alkyl or alkenyl group having a branch at the β carbon, relative to the oxygen atom (e.g, 2-hydroxy-2,3-dimethylhexane).

In each of the foregoing embodiments, Formula (IV) can comprise at least one optionally substituted branched alkyl or alkenyl group, wherein the location of the branching is selected from the group consisting of the α carbon, the β carbon, the γ carbon, the δ carbon, the ε carbon, and mixtures thereof, relative to the oxygen.

In each of the foregoing embodiments, the optional substituent(s) for $R_1$-$R_5$ in formulae (III)-(IV) may be one or more of halo groups, alkoxy groups, mercapto groups, nitro groups, nitroso groups, sulfoxy groups, pyridyl groups, furyl groups, thienyl groups, imidazolyl groups, and sulfur, and wherein no more than two non-hydrocarbon substituents are present for every ten carbon atoms in the alkyl or alkenyl group.

Particularly suitable alcohols are illustrated by the following non-limiting examples, 2-ethylhexanol, 2-butyloctanol, isomyristyl alcohol, 2-hexyldecanol, isostearyl alcohol, 2-octyldodecanol, 2-decyltetradecanol, 2-dodecylhexadecanol, 2-tetradecyloctadecanol 2-dodecylhexadecanol, 2-hexyloctanol 2-ethylhexanol, 2-hydroxy-2,3-dimethylhexane, 2-butylhexanol, 2-propylhexan-1-ol, 3-Propyl-1-hexanol, 3-methyl-1-heptanol, 3-ethylheptan-1-ol, 2-ethyl-4-methylhexan-1-ol, 2,4-diethylhexan-1-ol, 2-naphthol, benzyl alcohol, 3-phenoxybenzyl alcohol, 2-naphthylmethanol, 9-anthracenemethanol, 1-pyrenemethanol, 2-(9-anthracenylmethoxy)ethanol, 2-(9-anthracenyloxyethanol), and 1-naphthalene methanol.

Preferably, the alcohol is 1-naphthalene methanol.

Oxazolines

The oxazolines employed in the present disclosure are compounds that contain an oxazoline group. These compounds may include linear, branched, cyclic or aromatic hydrocarbyl groups.

Examples of suitable oxazolines for use in the present disclosure include the following compounds: 2-phenyl-2-oxazoline; 2-ethyl-2 oxazoline; 2-methyl-2-oxazoline; 2-benzyl-4,4-dimethyl-2-oxazoline; 2-ethyl-4,4-dimethyl-2 oxazoline; 2,4,4-trimethyl-2-oxazoline; 4,4-dimethyl-2-oxazoline; 2,4,5-trimethyl-3-oxazoline; 2-(2,6-dimethoxyphenyl)-4,4-dimethyl-2-oxazoline; 2-[1-(hydroxymethyl)ethyl] oxazoline; mixtures thereof, and derivatives thereof. In yet other approaches, the oxazoline or derivative thereof includes pendant groups in positions 2, 4, and 5 or combinations thereof wherein the pendant groups are selected from heterocyclic, aromatics, hydrocarbyl groups of $C_1$ to $C_{32}$, and mixtures thereof. Preferably, the oxazoline is 2-phenyl-2-oxazoline.

In a preferred embodiment of the disclosure, reactions with both components I)) and c) are employed. In an even more preferred embodiment, component b) is an amine, and component c) is selected from an amine, an alcohol, and an oxazoline as discussed above.

In a preferred embodiment of the disclosure, components b) and c) are amines. In an even more preferred embodiment, the amine is N-phenyl-1,4-phenylenediamine.

The Olefin Copolymer

The olefin copolymer may comprise ethylene-derived units and $C_3$-$C_{10}$ alpha-olefin-derived units. For example, the $C_3$-$C_{10}$ alpha-olefin-derived units may be propylene-derived units.

An ethylene-derived unit generally refers to a —$CH_2CH_2$— unit within a copolymer chain, which is derived from an ethylene molecule during copolymerization, with a similar definition applying to $C_3$-$C_{10}$ alpha-olefin-derived unit or any other specified derived unit. The term "olefin" is given its ordinary meaning in the art, e.g., referring to a family of organic compounds which are alkenes with a chemical formula $C_xH_{2x}$, where x is the carbon number, and having a double bond within its structure. The term "alpha-olefin" is given its ordinary meaning in the art and refers to olefins having a double bond within its structure at the primary or alpha position.

According to one or more embodiments, ethylene-$C_3$-$C_{10}$ alpha olefin copolymers are generally disclosed. The copolymer may comprise ethylene-derived units and $C_3$-$C_{10}$ alpha-olefin-derived units, wherein the $C_3$-$C_{10}$ alpha-olefin has $\alpha$ carbon number of three to ten. Thus, the carbon number of the $C_3$-$C_{10}$ alpha-olefin may be 3, 4, 5, 6, 7, 8, 9, or 10. In some preferred embodiments, the $C_3$-$C_{10}$ alpha-olefin-derived units comprise propylene-derived units. In some embodiments, the $C_3$-$C_{10}$ alpha-olefin-derived units may be 1-butylene-, 1-pentene-, 1-hexene-, 1-heptene-, 1-octene-, 1-nonene-, or 1-decene-derived units.

Crossover Temperature

One characteristic of the copolymer that helps to define its behavior in low temperatures is its crossover temperature, or onset temperature. A copolymer may generally be viscoelastic; in other words, its mechanical properties are between that of a purely elastic solid and that of a purely viscous liquid. The viscoelastic behavior of the copolymer may be characterized as the combination of an elastic portion (referred to, alternatively, as an elastic modulus or a storage modulus), and a viscous portion (referred to, alternatively, as a viscous modulus or a loss modulus). The values of these moduli are used to characterize the viscoelastic properties of the copolymer at a certain temperature. A copolymer that has a relatively higher elastic portion and a relatively lower viscous portion will behave more similarly to a purely elastic solid, while a copolymer that has a relatively lower elastic portion and a relatively higher viscous portion will behave more similarly to a purely viscous liquid. Both the storage modulus and the loss modulus are each functions of temperature, although they may change at different rates as a function of temperature. In other words, the copolymer may exhibit more elasticity or more viscosity, depending on the temperature. The highest temperature at which a value of a storage modulus of the copolymer equals a value of a loss modulus being measured by oscillatory rheometry is referred to as the crossover temperature or the onset temperature.

Oscillatory rheology is one technique that may be used to measure values (generally expressed in units of pressure) for the loss and storage moduli. The basic principle of an oscillatory rheometer is to induce a sinusoidal shear deformation in the sample (e.g., a sample of copolymer) and measure the resultant stress response. In a typical experiment, the sample is placed between two plates. While the top plate remains stationary, a motor rotates or oscillates the bottom plate, thereby imposing a time dependent strain on the sample. Simultaneously, the time dependent stress is quantified by measuring the torque that the sample imposes on the top plate.

Measuring this time dependent stress response reveals characteristics about the behavior of the material. If the material is an ideal elastic solid, then the sample stress is proportional to the strain deformation, and the proportionality constant is the shear modulus of the material. The stress is always exactly in phase with the applied sinusoidal strain deformation. In contrast, if the material is a purely viscous fluid, the stress in the sample is proportional to the rate of strain deformation, where the proportionality constant is the viscosity of the fluid. The applied strain and the measured stress are out of phase.

Viscoelastic materials show a response that contains both in-phase and out-of-phase contributions. These contributions reveal the extents of solid-like and liquid-like behavior. A viscoelastic material will show a phase shift with respect to the applied strain deformation that lies between that of solids and liquids. These can be decoupled into an elastic component (the storage modulus) and a viscosity component (the loss modulus). The viscoelastic behavior of the system thus can be characterized by the storage modulus and the loss modulus, which respectively characterize the solid-like and fluid-like contributions to the measured stress response.

As mentioned, the values of the moduli are temperature dependent. At warmer temperatures, the value of the loss modulus for the copolymer is greater than the value of the storage modulus. However, as the temperature decreases, the copolymer may behave more like an elastic solid, and the degree of contribution from the storage modulus approaches that from the loss modulus. As the temperature lowers, eventually, at a certain temperature the storage modulus crosses the loss modulus of the pure copolymer, and becomes the predominant contributor to the viscoelastic behavior of the pure copolymer. As stated above, the temperature at which the storage modulus equals the loss modulus of the pure copolymer is referred to as the crossover temperature or the onset temperature. According to one or more embodiments, a lower crossover temperature of the copolymer correlates to better low temperature performance of oils into which the copolymer is incorporated.

Thus, according to one or more embodiments, the copolymer may have a crossover temperature, that is to say, a temperature at which the storage modulus of the copolymer is equal to the loss modulus of the copolymer, of −20° C. or lower, −25° C. or lower, −30° C. or lower, −35° C. or lower, or −40° C. or lower, or −50° C. or lower, −60° C. or lower, or −70° C. or lower; e.g., as measured by oscillatory rheometry. Other values are also possible. An advantageous crossover temperature for the copolymer may be achieved through controlling characteristics of the copolymer during its manufacture, as discussed herein. One such characteristic is an average ethylene-run length.

Average Ethylene Run Length and Triad Distribution

According to one or more embodiments, the sequence of the ethylene-derived units and $C_3$-$C_{10}$ alpha-olefin derived units within the copolymer may be arranged in such a way as to provide good low temperature performance. The sequential arrangement of the different units may be characterized by an average ethylene-run length.

As used herein, "average ethylene run length" refers to the average ethylene monomer unit run length incorporated into the copolymer. The average ethylene-derived unit run length is defined as the total number of ethylene-derived units in the copolymer divided by a number of runs of one or more sequential ethylene-derived triad units in the copolymer, and the average ethylene-derived unit run length $n_{c2}$.

In a copolymer comprising ethylene and alpha-olefin monomer units (e.g., ethylene and propylene monomer moieties), neither of the monomer units will be distributed uniformly along the chain of the copolymer. Instead, the monomer units will be randomly distributed. For example, in a representative copolymer comprising four monomer units of A, and four monomer of B, the monomer units may be distributed as follows A-A-B-A-B-B-B-A, or in any other manner. The average run length of a monomer units within the copolymer is measured by dividing the total number of that monomer unit within the copolymer by the number of separate runs of that monomer unit. In the above example, there are a total of four monomer units of A and three separate runs of A. Therefore, the average A run length is 1.33. There are a total of four monomer units of B and two separate runs of B. Therefore, the average B run length is 2.0.

The theoretical average ethylene run length ($n_{c2,\ Statistical}$) for the copolymers herein can be calculated from Bernoullian statistics, shown in Equation 1 below. Equation 1 uses the measured mole fraction of ethylene incorporated in the copolymer, $x_{C2}$, to calculate the theoretical mole fraction of particular triads, which is used to calculated $n_{c2,\ Statistical}$. Triads are the possible combinations of three sequential monomer moieties in a copolymer. For example, in an ethylene-propylene copolymer, where "E" represents an ethylene monomer units and "P" represents a propylene monomer unit, potential combinations for triads include: E-E-E, E-E-P, P-E-P, E-P-E, P-P-E, and P-P-P.

To calculate the theoretical average ethylene run length ($n_{c2,\ Statistical}$), the mole fraction of ethylene incorporated in the copolymer, $x_{C2}$ is then inserted into Equations 2-4 to calculate the mole fractions of the triads, EEE, EEA, AEE, and AEA to determine $n_{c2}$, Statistical for a purely theoretical copolymer based on the statistical distributions of the triads.

$$n_{C2,Statistical} = \frac{(EEE) + (AEE + EEA) + (AEA)}{(AEA) + 0.5(AEE + EEA)} \quad \text{(Equation 1)}$$

$$(EEE) = (x_{C2})^3 \quad \text{(Equation 2)}$$

$$(AEE + EEA) = 2(x_{C2})^2(1 - x_{C2}) \quad \text{(Equation 3)}$$

$$(AEA) = x_{C2}(1 - x_{C2})^2 \quad \text{(Equation 4)}$$

The copolymers used to make the viscosity modifiers have an actual average ethylene run length ($n_{c2,Actual}$) that is less than the statistical average ethylene run length ($n_{c2,\ Statistical}$). the actual average ethylene run length ($n_{c2,\ Actual}$) may be calculated by measuring the triad distribution in the copolymer. The "triad distribution" is the sequential arrangement of monomer units in the copolymer. It refers to the statistical distribution of the possible combinations of three subunits in a row in a copolymer chain. Taking as an example an ethylene-propylene copolymer, where "E" represents an ethylene-derived unit and "P" represents a propylene-derived unit, potential combinations for monomer unit triads include: E-E-E, E-E-P, P-E-E, P-E-P, E-P-E, P-P-E, E-P-P and P-P-P. According to one or more embodiments, the amount of E-E-E is less than 20%, less than 10%, or less than 5%, an indication of a relatively short $n_{c2,Actual}$. The method used for calculating the triad distribution of ethylene-propylene copolymers is described in J. C. Randall *JMS-Review Macromolecules Chem Physics C*29, 201 (1989) and E.W. Hansen, K. Redford *Polymer* Vol. 37, No. 1, 19-24 (1996). After collecting $^{13}C$ NMR data under quantitative conditions, eight regions (A-H), shown in Table 2 are integrated. The equations of Table 3 are applied and the values normalized. For the examples described herein, the D, E, and F regions were combined due to peak overlap, k is a normalization constant and T=total intensity. The factor k is the NMR proportionality constant relating the observed resonance intensities to the number of contributing molecular species. It can later be removed through normalization once a complete set of triads is obtained, as explained in J. C. Randall JMS-*Review Macromolecules Chem Physics C*29, 201 (1989). Tables 2 and 3 are specifically intended to calculate the mole fraction of triads found within an ethylene-propylene copolymer. It is within one of skill in the art to modify the $C^{13}$ NMR data collection to calculate the triad mole fractions of copolymers comprising ethylene derived units and other $C_4$-$C_{10}$ alpha olefin derived units

TABLE 1

Integral Regions

| Region | Chemical Shift (ppm) |
|---|---|
| A | 43.5-48.0 |
| B | 36.5-39.5 |
| C | 32.5-33.5 |
| D | 29.2-31.2 |
| E | 28.5-29.3 |
| F | 26.5-27.8 |
| G | 23.5-25.5 |
| H | 19.5-22.5 |

TABLE 2

Equations

| |
|---|
| $k(EEE) = 0.5(T_{DEF} + T_A + T_C + 3T_G - T_B - 2T_H)$ |
| $K(PEE + EEP) = 0.5(T_H + 0.5T_B - T_A - 2T_G)$ |
| $k(PEP) = T_G$ |
| $k(EPE) = T_C$ |
| $k(EPP + PPE) = 0.5(2T_H + T_B - 2T_A - 4T_C)$ |
| $k(PPP) = 0.5(3T_A + 2T_C - 0.5T_B - T_H)$ |

The calculated mole fraction of the EEE, EEA, AEE and AEA triads are entered into Equation 5 in order to obtain $n_{c2,Actual}$. When measurements and calculations from an ethylene-propylene copolymer are used in Equation 5, AEE is PEE, EEA is EEP, and AEA is PEP.

$$n_{C2,Actual} = \frac{(EEE) + (AEE + EEA) + (AEA)}{(AEA) + 0.5(AEE + EEA)}. \quad \text{(Equation 5)}$$

The copolymers used to make the viscosity modifiers have an actual average ethylene run length ($n_{c2,\ Actual}$) less than the theoretical average ethylene run length ($n_{C2,statistical}$) and thus satisfy the relationship below:

$$n_{C2,Actual} < n_{C2,Statistical} \quad \text{(Equation 6)}$$

Not only do the copolymers used to make the viscosity modifiers herein have an $n_{C2,Actual}$ less than $n_{C2,statistical}$, but the copolymers must also have a $n_{C2,Actual}$ less than 2.6. The viscosity modifiers comprising olefin copolymers herein having an $n_{C2,Actual}$, less than 2.6 exhibit improved performance. Accordingly, the copolymers of the viscosity modifiers herein may have $n_{C2,Actual}$ less than 2.5, less than 2.4, less than 2.3, less than 2.1, less than 2.0, or less than 1.9.

For the copolymers herein, the amount of E-E-E may be less than about 20%, less than about 10%, or less than about 5%, which is an indication of a relatively short average ethylene run length.

Copolymers having the properties described above, i.e., a measured average ethylene run length of less than 2.6 and satisfying Equation (6) have improved properties. Viscosity modifiers comprising these copolymers when used in lubricants have improved low temperature properties.

According to one or more embodiments, the copolymer may be synthesized by a process through which the $$n_{C2,Actual} < n_{C2,Statistical} \quad \text{(Equation 6)}$$

Where the average run length is less than what would be expected from random distribution, the copolymer is between statistical and alternating. Alternatively, where the average run length is greater than would be expected from random distribution, the copolymer is between statistical and blocky.

According to one or more embodiments, the average ethylene run length in the copolymer, at least in part, a function of the percentage of ethylene units in the copolymer, and the chosen catalysts. For example, a higher percentage of ethylene units will naturally result in a higher average run length. The choice of catalyst affects the average run length, because the catalyst affects the relative rate of insertion of the different units.

Thus, using an ethylene-propylene copolymer as an illustrative example, during copolymer chain formation, the reaction rate at which an ethylene molecule bonds to a preceding ethylene unit at the end of the growing polymer chain is referred to as the ethylene-ethylene propagation reaction rate constant ("$k_{pEE}$"). The reaction rate at which a propylene (or other $C_3$-$C_{10}$ alpha-olefin co-monomer) bonds to an ethylene unit at the end of the growing polymer chain is referred to as the ethylene-propylene propagation reaction rate constant ("$k_{pEp}$"). The reactivity ratio of ethylene ("$r_E$") refers to the ratio of the ethylene-ethylene propagation reaction rate constant to the ethylene-propylene reaction rate constant, $k_{pEE}/k_{pEP}$.

Likewise, the reaction rate at which a propylene (or other $C_3$-$C_{10}$ alpha-olefin) molecule bonds to a propylene-derived unit at the end of the growing polymer chain is referred to as the propylene-propylene reaction rate constant ("$k_{pPP}$"). The reaction rate at which an ethylene molecule bonds to a propylene unit at the end of the growing polymer chain is referred to as the ethylene-propylene reaction rate constant ("$k_{pPE}$"). The reactivity ratio of propylene ("$r_P$") refers to the ratio of the propylene-propylene reaction rate constant to the propylene-ethylene reaction rate constant, $k_{pPP}/k_{pPE}$.

The lower each of the reactivity ratios ($r_E$ or $r_P$) are, the more likely it is that a different unit will follow the one preceding (e.g., ethylene follow propylene or vice versa) and the resulting polymer chain will have an alternating character, with a lower average ethylene run length than would otherwise be expected from a purely random distribution of units. According to one or more embodiments, selection of an appropriate catalyst as discussed herein, as well as control of other process parameters, may reduce the reactivity ratios and therefore the average ethylene run length, e.g., when copolymerized with propylene or other $C_3$-$C_{10}$ alpha olefins as discussed herein.

A lower average ethylene run length may provide certain advantages. For example, it may result in a lower crossover temperature for the copolymer. In general, without wishing to be bound by any theory, it is believed that the shorter the average ethylene run length for a given ethylene unit content, the lower the crossover temperature of the copolymer.

According to one or more embodiments, a copolymer comprising ethylene-derived units and $C_3$-$C_{10}$ alpha-olefin-derived units:

$$n_{C2,Actual} < n_{C2,Statistical} \quad \text{(Equation 6).}$$

Figure 3:
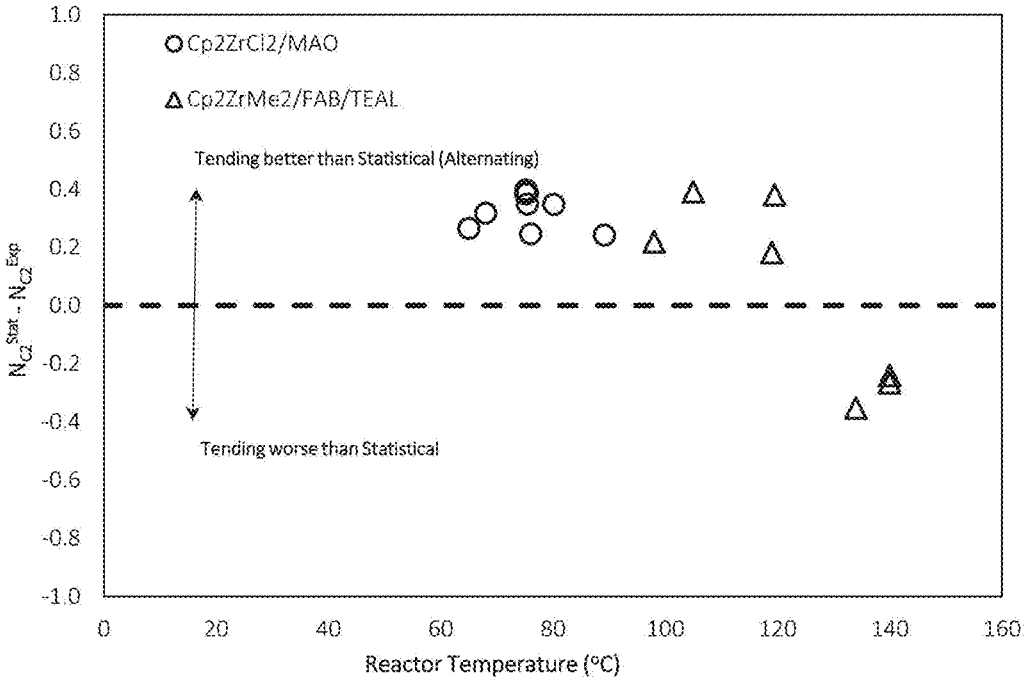
FIG. 3 is a graphical representation of the effect of reactor temperature on microstructure, according to one or more embodiments.

For example, as shown in FIG. 3, use of a coordination polymerization catalyst comprising the coordinated metallocene $Cp_2ZrCl_2$, and methylaluminoxane as a co-catalyst, under certain reaction conditions, results in the production of a copolymer having an average ethylene run length that is less than the statistically expected run length for a random distribution at a given percentage of ethylene units.

According to one or more embodiments, the copolymer may have an average ethylene run length that is less than 3.0, less than 2.9, less than 2.8, less than 2.7, less than 2.6, less than 2.5, less than 2.4, less than 2.3, less than 2.1, or less than 2.0.

Statistical and Alternating Microstructures

Copolymers of ethylene ($C_2$) and propylene ($C_3$) produced with perfectly alternating microstructures would not have a distribution of $C_2$ run lengths, as every ethylene sequence is exactly the same. The ethylene run length for a perfectly alternating microstructure is calculated from Equation (7).

$$n_{C2,Alternating} = \frac{x_{C2}}{(1 - x_{C2})} \quad \text{(Equation 7)}$$

However, copolymers that do not have a perfectly alternating microstructure would have a distribution of $C_2$ run lengths, and the prediction of a purely statistical microstructure represents the average $C_2$ run length (also referred to as, the "average ethylene run length") for the distribution of $C_2$ run lengths. The average $C_2$ run length for copolymers produced with a purely statistical microstructure can be calculated from Bernoullian statistics, shown in Equation (2). The mole fraction of ethylene incorporated in an ethylene-propylene copolymer, $x_{C2}$, is used to calculate the fraction of EEE, EEP, PEE and PEP (there are also EPE, PPE, EPP, and PPP triads) triads in a purely statistical copolymer through Equations (1)-(4).

$$n_{C2,Statistical} = \frac{(EEE) + (AEE + (EEA) + (AEA)}{(AEA) + 0.5(AEE + EEA)} \quad \text{(Equation 1)}$$

$$(EEE) = (X_{C2})^3 \quad \text{(Equation 2)}$$

$$(AEE + EEA) = 2(x_{C2})^2(1 - x_{C2}) \quad \text{(Equation 3)}$$

Figure 2:
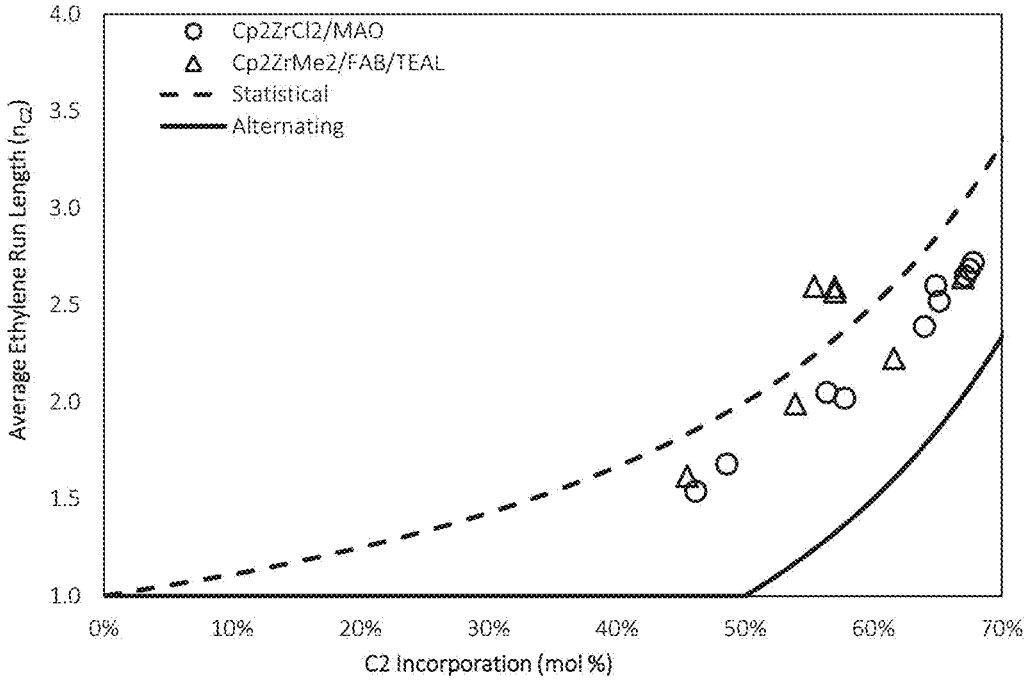
FIG. 2 is a graphical representation of the comparison of average ethylene run length to purely statistical and alternating microstructures at different ethylene incorporations for $C_2/C_3$ copolymers, according to one or more embodiments.

The actual $C_2$ incorporation in mol % can be measured using from $^1$H-NMR or $^{13}$C-NMR using standard techniques known to those of ordinary skill in the art. The actual average $C_2$ run length can be determined from $^{13}$C-NMR using standard techniques. The comparison between the actual average $C_2$ run length and the calculations for the alternating and statistical results are shown in FIG. 2 at the different ethylene incorporations. A comparison of the actual average $C_2$ run length to the calculated statistical and alternating results yields an indication of whether the copolymers produced have microstructures worse or better than statistical. Without being bound by any theory, it is believed that microstructures that are worse than statistical have a broader distribution of $C_2$ run lengths about the average.

Increasing the ethylene unit content of the copolymer increases the plasticization efficiency, plasticization durability, and oxidative stability of the plasticizer but also decreases the amount of structure forming that may occur at lower temperatures. It is unexpected that the particular combination of properties and microstructure of the copolymer of the present disclosure provides adequate plasticization efficiency, plasticization durability, and oxidative stability while at the same time providing a good low temperature performance.

The results known in FIG. 2 were produced with two different catalyst systems. The ethylene incorporation was controlled during the polymerization using standard techniques known in the art. The copolymerization using the $Cp_2ZrCl_2$/MAO catalyst system was carried out at a lower temperature and within a narrower temperature range than the copolymerization using the $Cp2ZrMe_2$/FAB/TEAL catalyst system, shown in FIG. 3.

The copolymerization reaction can be controlled to provide the desired copolymers. Parameters such as the reaction temperature, pressure, mixing, reactor heat management, feed rates of one or more of the reactants, types, ratio, and concentration of catalyst and/or co-catalyst and/or scavenger as well as the phase of the feed components can be controlled to influence the structure of the copolymer obtained from the reaction. Thus, a combination of several different reaction conditions can be controlled to produce the desired copolymer.

For example, it is important to run the copolymerization reaction with appropriate heat management. Since the copolymerization reaction is exothermic, in order to maintain a desired set point temperature in the reactor heat must be removed. This can be accomplished by, for example, two different methods often practiced in combination. Heat can be removed by cooling the feed stream to the reactor to a temperature well below the reaction set point temperature (even sometimes cryogenically) and therefore allowing the feed stream to absorb some of the heat of reaction through a temperature rise. In addition, heat can be removed from the reactor by external cooling, such as a cooling coil and/or a cooling jacket. The lower the set point temperature in the reactor, the more demand there is for heat removal. The higher the reaction temperature, the less heat needs to be removed, or alternatively or in combination, the more concentrated the copolymer can be (higher productivity) and/or the shorter the residence time can be (smaller reactor). The results characterizing the deviation of the average ethylene run length from a purely statistical microstructure are shown in FIG. 3 for both catalyst systems plotted versus the temperature of the reactor during the copolymerization.

As the reaction temperature was increased beyond 135° C., it appears that control of the microstructure may be lost and the copolymer typically becomes worse than statistical. As a result, the low temperature properties of the copolymer may be compromised. Without being bound by theory, the reduced control of the microstructure of copolymers produced at higher temperatures is believed to be due to a drop in the reaction kinetics of comonomer incorporation relative to ethylene incorporation. The more difficult it is for the comonomer to incorporate in the copolymer, the less regularly the comonomer breaks up the runs of ethylene units in the chain during copolymerization. Some strategies for improving the incorporation of comonomer at higher reaction temperatures include increasing the ratio of monomers of $C_3$-$C_{10}$ alpha-olefin/ethylene in the reactor, increasing the Al/Zr ratio in the catalyst or by making changes in the catalyst architecture.

Thus, in some embodiments, reaction temperatures of 60-135° C. are employed for the copolymerization reaction, or, more preferably, reaction temperatures of 62-130° C., or 65-125° C., or preferably 68-120° C. or 70-90° C., are employed for the copolymerization reaction.

Preferred Al/Zr ratio in the catalyst system may be less than 10,000:1, less than 1,000:1, less than 100:1, less than 10:1, less than 5:1, or less than 1:1. For boron-containing technology, preferred Al/Zr ratio in the catalyst is less than 100:1, less than 50:1, less than 10:1, less than 5:1, less than 1:1, less than 0.1:1 and preferred B/Zr ratio is less than 10:1, less than 5:1, less than 2:1, less than 1.5:1, less than 1.2:1, or less than 1:1.

Low temperature properties of the copolymer can be correlated to the microstructure of the copolymer. Low temperature performance of the pure copolymer is measured by Oscillatory Rheometry. The point at which storage modulus is equal to the loss modulus, namely, the crossover or onset temperature, is an indication of the temperature at which the copolymer will begin to exhibit unfavorable structure forming. The crossover temperature is the point at which the structure formed in the copolymer exceeds the liquid-like character of the copolymer. This temperature has been shown to be predictive for determining the impact of the copolymer structure on low temperature performance as a polyolefin plasticizer.

Figure 4:
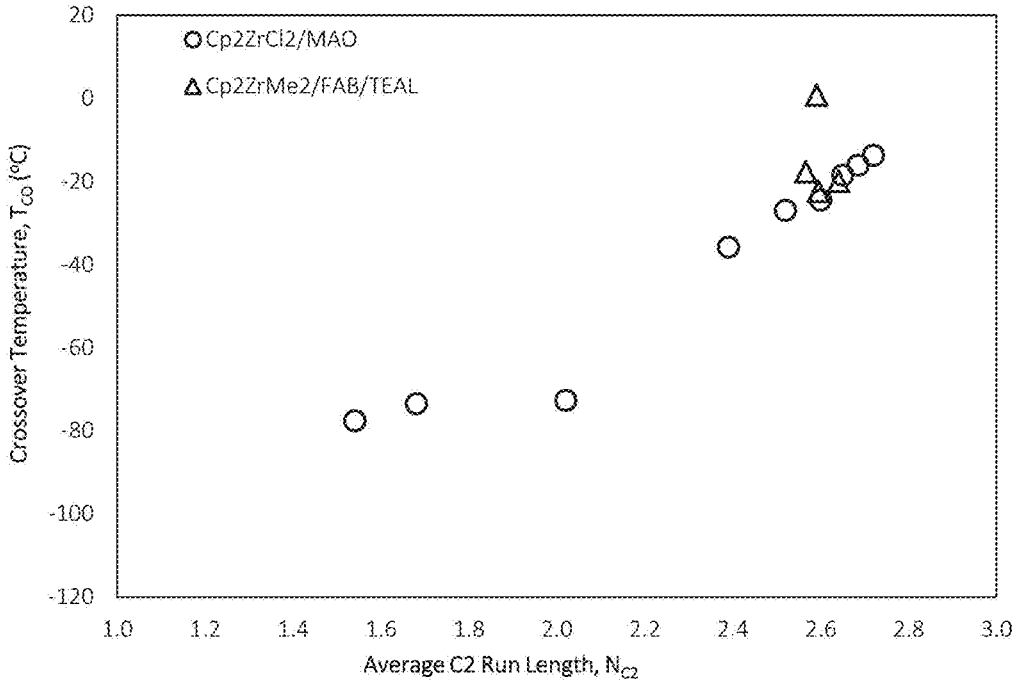
FIG. 4 is a graphical representation of the crossover temperature versus average ethylene run length for worse than statistical and better than statistical microstructures, according to one or more embodiments.
Figure 5:
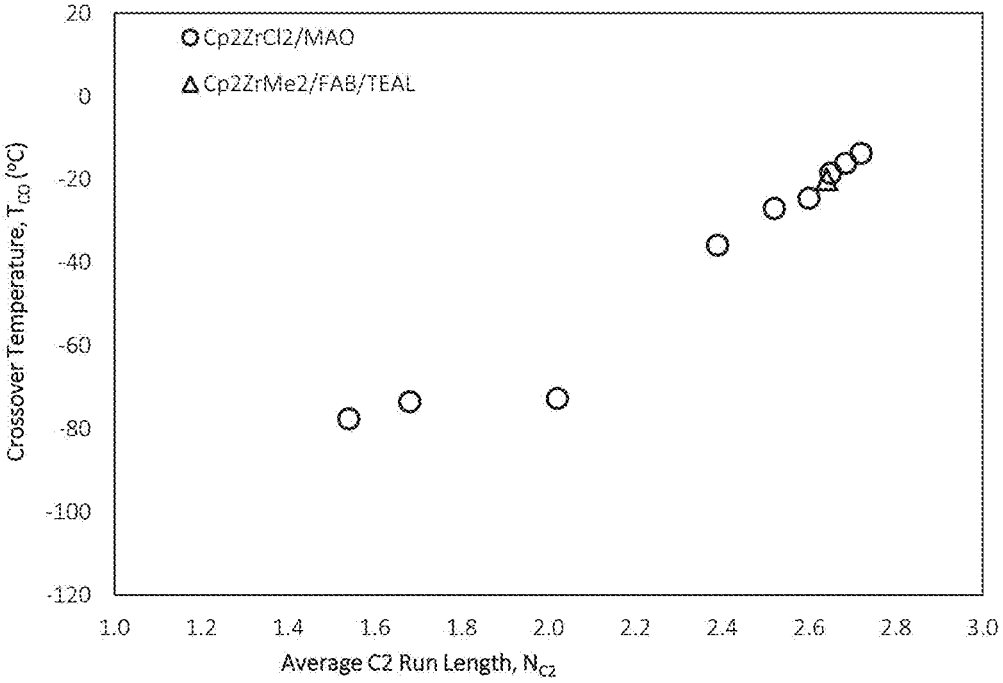
FIG. 5 is a graphical representation of the crossover temperature versus average ethylene run length for only copolymers better than statistical microstructures, according to one or more embodiments.

The impact of average ethylene run length on crossover temperature is shown in FIG. 4. The copolymers produced with the $Cp_2ZrCl_2$/MAO catalyst system are well-behaved and there is a strong correlation between crossover temperature and average ethylene run length. The copolymers produced with the $Cp_2ZrMe_2$/FAB/TEAL catalyst system can be controlled to provide the desired combination crossover temperature and average ethylene run length. A particularly wide range of crossover temperatures is observed for the copolymers produced using the $Cp_2ZrMe_2$/FAB/TEAL catalyst system is shown in FIG. 4. Specifically, at an approximate average $C_2$ unit run length of 2.6, the crossover temperature of these copolymers varies from almost −40° C. to about 5° C. This wide range in crossover temperature correlates with the wide variety of different microstructures that was also observed for these copolymers at the same average ethylene run length. In FIG. 5 only the data exhibiting better than statistical microstructures are included.

The Number Average Molecular Weight

The number average molecular weight (Mn) of the copolymer is determined by gel permeation chromatography (GPC) using polystyrene (with a Mn of 180 to about 18,000) as the calibration reference, as described in U.S. Pat. No. 5,266,223. The GPC method additionally provides molecular weight distribution information; see W. W. Yau, J. J. Kirkland and D. D. Bly, "Modern Size Exclusion Liquid Chromatography," John Wiley and Sons, New York, 1979. According to some embodiments, the copolymer may have a number average molecular weight (Mn) of 5,000 g/mol to 200,000 g/mol, or from 10,000 g/mol to 175,000 g/mol, or from 20,000 g/mol to 150,000 g/mol, or from 25,000 g/mol to 125,000 g/mol, or from 30,000 g/mol to 100,000 g/mol, as determined by GPC utilizing the polystyrene standard.

Combinations of the end points of any of the above-referenced ranges are also within the scope of the disclosure.

The polydispersity index (PDI) of the copolymer is a measure of the variation in size of the individual chains of the copolymer. The polydispersity index is determined by dividing the weight average molecular weight (Mw) of the copolymer by the number average molecular weight (Mn) of the copolymer. The term number average molecular weight (Mn) is given its ordinary meaning in the art, and is defined as the sum of the products of the weight of each polymer chain and the number of polymer chains having that weight, divided by the total number of polymer chains. The weight average molecular weight of the copolymer is given its ordinary meaning in the art and is defined as the sum of the products of the weight squared of each polymer chain and the total number of polymer chains having that weight, divided by the sum of the products of the weight of each polymer chain and the number of polymer chains having that weight. According to one or more embodiments, the PDI of the copolymer may be less than or equal to 4, less than or equal to 3, less than or equal to 2, or less than or equal to 1.

Ethylene Unit Content

The copolymer may comprise a certain mole percentage (mol %) of ethylene derived units in some embodiments. According to some embodiments, the ethylene unit content of the copolymer, relative to the total amount of the units within the copolymer, is at least 10 mol %, at least 20 mol %, at least 30 mol %, at least 40 mol %, at least 45 mol %, at least 50 mol %, at least 55 mol %, at least 60 mol %, at least 65 mol %, at least 70 mol %, or at least 75 mol %. According to some embodiments, the ethylene unit content of the copolymer is less than 90 mol %, less than 87 mol %, less than 85 mol %, less than 80 mol %, less than 75 mol %, less than 70 mol %, less than 65 mol %, less than 60 mol %, less than 55 mol %, less than 50 mol %, less than 45 mol %, less than 40 mol %, less than 30 mol %, or less than 20 mol %, Combinations of the above-referenced ranges are also possible (e.g., at least 10 mol % and less than 90 mol %, at least 20 mol % and less than 87 mol %, at least 30 mol % and less than 85 mol %, at least 40 mol % and less than 80 mol %).

Comonomer Unit Content

The copolymer may comprise a certain mole percentage of comonomer units, where the comonomer is selected from a group consisting of $C_3$-$C_{10}$ alpha-olefins having a carbon number at or between 3 and 10, e.g., propylene. According to some embodiments, the comonomer unit content of the copolymer, relative to the total amount of the monomers within the copolymer, is at least 10 mol %, at least 13 mol %, at least 15 mol %, at least 20 mol %, at least 25 mol %, at least 30 mol %, at least 35 mol %, at least 40 mol %, at least 45 mol %, at least 50 mol %, at least 55 mol %, at least 60 mol %, at least 65 mol %, at least 70 mol %, or at least 80 mol %. According to some embodiments, the comonomer unit content of the copolymer is less than 90 mol %, less than 80 mol %, less than 70 mol %, less than 65 mol %, less than 60 mol %, less than 55 mol %, less than 50 mol %, less than 45 mol %, less than 40 mol %, less than 35 mol %, less than 30 mol %, less than 25 mol %, less than 20 mol %, less than 90 mol %, as measured by $^1$H NMR spectroscopy. Combinations of the above reference ranges are possible (e.g., at least 40 mol %, and less than 60 mol %). Other ranges are also possible.

The term "olefin" is given its ordinary meaning in the art, and generally refers to a family of organic compounds which are alkenes with a chemical formula $C_xH_{2x}$, where x is the carbon number and having a double bond within its structure. The term "alpha-olefin" is also given its ordinary meaning in the art and refers to olefins having a double bond within its structure at the primary or alpha position.

Terminal Unsaturation

The copolymers herein may terminate with either an ethylene monomer unit or a $C_3$-$C_{10}$ alpha olefin monomer unit and include at least about 70 mol % terminal unsaturation. "Terminal unsaturation" refers to a carbon-carbon double bond wherein at least one of the carbons is derived from the terminal monomer unit, either the ethylene monomer unit or the $C_3$-$C_{10}$ alpha olefin monomer unit copolymer. The copolymer may have greater than 75 mol % terminal unsaturation, greater than 80 mol % terminal unsaturation, greater than 85 mol % terminal unsaturation, greater than 90 mol % terminal unsaturation, greater than 95 mol % terminal unsaturation, greater than 97 mol % terminal unsaturation. The mol % of terminal unsaturation is measured by, $^{13}$C NMR. See, e.g., U.S. Pat. No. 5,128,056.

Terminal Groups

If the copolymer terminates in an ethylene monomer unit, the terminal group on the copolymer is vinyl or di-substituted isomer of vinyl. If the copolymer terminates in $C_3$-$C_{10}$ alpha-olefin monomer unit, the terminal group on the copolymer is a terminal vinylidene or a tri-substituted isomer of the terminal vinylidene.

In the copolymer used to make the detergents described herein, at least 70 mol % of the terminal unsaturation is derived from a $C_3$-$C_{10}$ alpha olefin. That is at least 70 mol % of the terminal unsaturation is a terminal vinylidene, one or more tri-substituted isomers of the terminal vinylidene or any combination thereof having one or more of the following structural formulas IV-VI:

(Formula V)

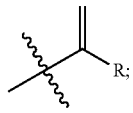

(Formula VI)

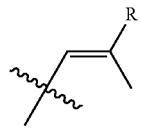

; and or (Formula VII)

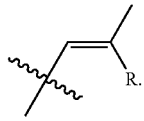

For Formulas V-VII, R represents an alkyl (e.g., methyl if the terminal group is derived from propylene, ethyl if the terminal group is derived from 1-butene, etc.) and

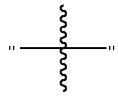

indicates the bond is attached to the remaining portion of the copolymer. For the avoidance of doubt, one of skill in the art will understand that the first carbon atom to the right of

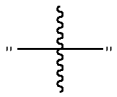

in Formulas (VI) and (VII) is from the penultimate monomer unit.

As used herein, the term "terminal vinylidene" refers to the structure represented by Formula V. As used herein, the term "tri-substituted isomer of terminal vinylidene" refers to the structures represented by Formulas VI and/or VII.

Terminal vinylidene, tri-substituted isomers of terminal vinylidene, and other types of terminal unsaturated bonds can be detected by $^1$H-NMR. From the integrated intensity of each signal, the amount of each unsaturated bond can be determined, as discussed in U.S. Patent Publication No. 2016/0257862.

Copolymerization

According to one or more embodiments, various methods are provided for synthesizing the copolymers described herein. One method is polymerizing ethylene and a $C_3$-$C_{10}$ alpha-olefin in the presence of a single-site coordination polymerization catalyst to produce a copolymer comprising ethylene-derived units and $C_3$-$C_{10}$ alpha-olefin-derived units.

According to one or more embodiments, the coordination polymerization catalyst may comprise a coordinated metallocene. A metallocene comprises cyclopentadienyl anions ("Cp") bound to a metal center. The coordinated metallocene may comprise a zirconium. For example, the coordinated metallocene may comprise $Cp_2ZrCl_2$. The coordination polymerization catalyst may further comprises a co-catalyst. The co-catalyst may comprise, for example, methylaluminoxane.

The copolymer may be produced in a reactor. Parameters that may be controlled during the process include pressure and temperature. The reaction may be operated continuously, semi-continuously, or batchwise. The ethylene may be delivered to a reactor through a metered feed of ethylene gas. The additional $C_3$-$C_{10}$ alpha-olefin component (e.g., propylene) of the copolymer may be delivered through a separate metered feed. The catalyst and co-catalyst may be delivered to the reactor in solution. The weight percent of either the catalyst or co-catalyst in the solution may be less than 20 wt %, less than 15 wt %, less than 10 wt %, less than 8 wt %, less than 6 wt %, less than 5 wt %, less than 4 wt %, less than 3 wt %, less than 2 wt %, or less than 1 wt %, according to different embodiments. The components may then be mixed in the reactor. Examples of different processes for forming the copolymer are described in the examples below.

In some embodiments, the microstructures are obtained by uniformally spatially distributing the composition within a reactor. Methods of ensuring composition uniformity include, but are not limited to, agitation, feed locations of monomers, solvent and catalyst components, and methods for introducing. Additional factors that may impact compositional uniformity in some cases include ensuring operating at optimal temperature and pressure space that provides a single fluid phase with the reactor based on the reactor composition and quite possibly ensuring the reactor temperature and pressure conditions are above the entire vapor-liquid phase behavior envelope of the feed composition. It is also envisioned that premixing of two or more of the feed components may be important and the premixing time and mixing intensity of the feed components is important for control of uniformity within the reactor, at least in some cases. Another subtle, but important feature of certain embodiments is to ensure no pockets of vapor exist within the reactor that would create a composition gradient either at a vapor-liquid interface or within the liquid. Lower temperatures are also believed to be important for controlling the reactivity ratios in a manner that leads to microstructures with better than statistical microstructures and tending toward alternating microstructures. Some or all of the above may be important for controlling the microstructure within a polymer chain and also the comonomer composition variation from chain to chain, in various embodiments.

Low Metal and/or Fluorine Content

Low metal content copolymers are desirable for many uses due to the harmful effects of metals in various environments. For example, metals or ash can have an adverse impact on after-treatment devices employed in various types of engines. It is also desirable to ensure that the copolymers have a low fluorine content since fluorine is ecologically undesirable in many environments.

There are several methods to achieve a low metal content in the copolymer as described herein. Methods known by those skilled in the art to purify and remove impurities may be employed. For example, in Giuseppe Forte and Sara Ronca, "Synthesis of Disentangled Ultra-High Molecular Weight Polyethylene: Influence of Reaction Medium on Material Properties," International Journal of Polymer Science, vol. 2017, Article ID 7431419, 8 pages, 2017. doi: 10.1155/2017/7431419, methods for purifying a polyethylene compound are disclosed. The method of purifying the copolymer comprises dissolving the copolymer in acidified methanol ($CH_3OH$/HCl) to a DCM (dichloromethane) solution of the polymer/catalyst mixture. This results in precipitation of the "purified" polymer, while the catalyst and other byproducts remain in solution. The copolymer may then be filtered and washed out with additional methanol, and oven dried under vacuum at 40° C.

According to one or more embodiments, the copolymer may be purified to achieve a low metal content by passing the polymer/catalyst mixture through an adsorption column. The adsorption column contains an adsorber, preferably, activated alumina.

In a more preferred embodiment, the copolymer may be purified to achieve a low metal content by stripping the polymer compositions using toluene and a rotavap with a temperature-controlled oil bath.

In an alternative embodiment, the copolymer does not require a purification step. In this embodiment, the copolymer is preferably copolymerized using a catalyst having a catalyst productivity of from 200-1500 kg copolymer/gram of single-site catalyst, or from 350-1500 kg copolymer/gram of single-site catalyst, or from 500-1200 kg copolymer/gram of single-site catalyst, or from 500-800 kg copolymer/gram of single-site catalyst. Suitable single-site catalyst systems having these productivities may be selected from those known in the art. The catalysts may be selected for the production of copolymers having Mn's in the range of 700-1400 g/mol. or from 550-650 g/mol. Selection of a suitable single-site catalyst may eliminate the need for a wash step to achieve the low metal content of the copolymer.

Catalyst productivity, expressed as the kg polymer produced per gram of catalyst, may be improved by efficient catalyst systems. Catalyst systems known by those skilled in the art which are capable of achieving high catalyst productivities may be employed. For example, U.S. Pat. No. 9,441,063 relates to catalyst compositions containing activator-supports and half-metallocene titanium phosphinimide complexes or half-metallocene titanium iminoimidazolidides capable of producing polyolefins with high catalyst productivities of at least up to 202 kg polymer/g catalyst (551 kg polymer/g cat/hr with a 22 min residence time, See Example 5 and Table 1, Columns 47 and 48.) Also, U.S. Pat. No. 8,614,277 relates to methods for preparing isotactic polypropylene and ethylene-propylene copolymers. U.S. Pat. No. 8,614,277 provides catalyst systems suitable for preparing copolymers at catalyst productivity levels greater than 200 kg polymer/g catalyst. The catalysts provided therein are metallocenes comprising zirconium as their central atom. (See the examples in Tables 1a-1c).

The copolymer may comprise a metal or ash content of 25 ppmw or less, based on the total weight of the copolymer. Preferably, the metal or ash content of the copolymer is 10 ppmw or less, or more preferably 5 ppmw or less, or even more preferably 1 ppmw or less, based on the total weight of the copolymer. Typically, the metal or ash content of the copolymer is derived from the single-site catalyst and optional co-catalyst(s) employed in the copolymerization reactor.

These single-site catalysts may include metallocene catalysts. Zr and Ti metals are typically derived from such metallocene catalysts. Various co-catalysts may be employed in combination with the single-site catalyst. Such co-catalysts may include boron and aluminum metals, as well as ecologically undesirable fluorine atoms or compounds. Thus, the metal or ash content of the copolymers of the present disclosure is the total metal or ash including Zr. Ti, Al and/or B. Various suitable catalyst systems are described elsewhere herein.

The copolymers may have a fluorine content of less than 10 ppmw, or less than 8 ppmw, or less than 5 ppmw, based on the total weight of the copolymer. Typically, the fluorine will come from co-catalyst systems based on boron compounds such as perfluoroaryl boranes.

The Acylating Agent

According to one or more embodiments, the ethylene alpha-olefin copolymer described herein is acylated. The ethylene/$C_3$-$C_{10}$ alpha-olefin copolymers can be functionalized by incorporating at least one functional group in the copolymer structure. Exemplary functional groups may be incorporated by grafting, for example, ethylenically unsaturated mono- and di-functional carboxylic acids, ethylenically unsaturated mono- and di-functional carboxylic acid anhydrides, salts thereof and esters thereof and epoxy-group containing esters of unsaturated carboxylic acids onto the ethylene/$C_3$-$C_{10}$ alpha-olefin copolymers. Such functional groups may be incorporated into the copolymer by reaction with some or all of the unsaturation in the copolymer. Typically, the functional group will be an acyl group.

Examples of the unsaturated carboxylic acids, dicarboxylic acids which may be used to make the acylated copolymer are those having about 3 to about 20 carbon atoms per molecule such as acrylic acid, methacrylic acid, cinnamic acid, crotonic acid, maleic acid, fumaric acid and itaconic acid. More preferably, the carboxylic reactants are selected from the group consisting of maleic acid, fumaric acid, maleic anhydride, or a mixture of two or more of these. Unsaturated dicarboxylic acids having about 4 to about 10 carbon atoms per molecule and anhydrides thereof are especially preferred. Compounds that can be reacted with the unsaturation in the ethylene/$C_3$-$C_{10}$ alpha-olefin copolymers include for example, maleic acid, fumaric acid, itaconic acid, citraconic acid, cyclohex-4-ene-1,2-di-carboxylic acid, bicyclo[2.21]hept-5-ene-2,3-dicarboxylic acid, maleic anhydride, itaconic anhydride, citraconic anhydride, allylsuccinic anhydride, 4-methylcyclohex-4-ene-1,2-dicarboxylic anhydride and bicyclo[2.2.1]hept-5-ene-2,3-dicarboxylic anhydride. One particularly useful functional group may be introduced using maleic anhydride.

The amount of the acyl group present in the acylated copolymer can vary. The acyl group can typically be present in an amount of at least about 0.3 weight percent, or at least 1.0 weight percent, preferably at least about 5 weight percent, and more preferably at least about 7 weight percent. The acyl group will typically be present in an amount less than about 40 weight percent, preferably less than about 30 weight percent, and more preferably less than about 25 weight percent, or less than about 10 weight percent and more preferably less than about 5 weight percent. Combinations of the above reference ranges are possible.

The ethylenically unsaturated carboxylic acid materials typically can provide one or two acyl groups per mole of reactant to the grafted polymer. For example, methyl methacrylate can provide one acyl group per molecule to the grafted polymer while maleic anhydride can provide two acyl groups per molecule to the grafted polymer.

The carboxylic reactant is reacted or grafted onto the ethylene/$C_3$-$C_{10}$ alpha-olefin copolymers in an amount to provide from about 0.1 to about 0.8 acyl groups per 1000 number average molecular weight units of the ethylene/$C_3$-$C_{10}$ alpha-olefin copolymers. As another example, the carboxylic reactant is reacted or grafted onto the prescribed ethylene/$C_3$-$C_{10}$ alpha-olefin copolymers in an amount to provide from about 0.15 to about 1.4 acyl groups per 1000 number average molecular weight units of the ethylene/$C_3$-$C_{10}$ alpha-olefin copolymers. As further example, the carboxylic reactant is reacted or grafted onto the ethylene/$C_3$-$C_{10}$ alpha-olefin copolymers in an amount to provide from about 0.3 to about 0.75 acyl groups per 1000 number average molecular weight units of the ethylene/$C_3$-$C_{10}$ alpha-olefin copolymers. As an even further example, the carboxylic reactant is reacted or grafted onto the ethylene/$C_3$-$C_{10}$ alpha-olefin copolymers in an amount to provide from about 0.3 to about 0.5 acyl groups per 1000 number average molecular weight units of the ethylene/$C_3$-$C_{10}$ alpha-olefin copolymers.

For example, a copolymer substrate with an Mn of 20,000 g/mol. may be reacted or grafted with 6 to 15 acyl groups per polymer chain or 3 to 7.5 moles of maleic anhydride per mole of copolymer. A copolymer with an Mn of 100,000 g/mol. may be reacted or grafted with 30 to 75 acyl groups per polymer chain or 15 to 37.5 moles of maleic anhydride per polymer chain.

The grafting reaction to form the acylated olefin copolymers is generally carried out with the aid of a free-radical initiator either in solution or in bulk, as in an extruder or intensive mixing device. In some cases, it may be economically desirable to carry out the grafting reaction in hexane as described in U.S. Pat. Nos. 4,340,689, 4,670,515 and 4,948,842. The resulting grafted copolymer is characterized by having carboxylic acid acyl functionalities randomly distributed within its structure.

In the bulk process for forming the acylated olefin copolymers, the olefin copolymer fed to rubber or plastic processing equipment such as an extruder, intensive mixer or masticator, heated to a temperature of 150° C. to 400° C. and the ethylenically unsaturated carboxylic acid reagent and free-radical initiator may then be separately co-fed to the molten polymer to effect grafting. The reaction is optionally carried out with mixing condition to effect shearing and grafting of the ethylene copolymers according to, for example, the method of U.S. Pat. No. 5,075,383. The processing equipment is generally purged with nitrogen to prevent oxidation of the polymer and to aid in venting unreacted reagents and byproducts of the grafting reaction. The residence time in the processing equipment is sufficient to provide for the desired degree of acylation and to allow for purification of the acylated copolymer via venting. Mineral or synthetic engine oil may optionally be added to the processing equipment after the venting stage to dissolve the acylated copolymer.

Other methods known in the art for effecting reaction of ethylene-olefin copolymers with ethylenically unsaturated carboxylic reagents are described, for example, in U.S. Pat. No. 6,107,257.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

In another alternative embodiment the antioxidant composition also contains a molybdenum-containing antioxidant in addition to the phenolic and/or aminic antioxidants discussed above. When a combination of these three antioxidants is used, preferably the ratio of phenolic to aminic to molybdenum-containing is (0 to 2):(0 to 2):(0 to 1).

The one or more antioxidant(s) may be present in ranges about 0 wt % to about 20 wt %, or about 0.1 wt % to about 10 wt %, or about 1 wt % to about 5 wt %, of the lubricating oil composition.

Antiwear Agents

The lubricating oil compositions herein also may optionally contain one or more antiwear agents. Examples of suitable antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Boron-Containing Compounds

The lubricating oil compositions herein may optionally contain one or more boron-containing compounds.

Examples of boron-containing compounds include borate esters, borated fatty amines, borated epoxides, borated detergents, and borated dispersants, such as borated succinimide dispersants, as disclosed in U.S. Pat. No. 5,883,057.

The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating oil composition.

Detergents

The lubricating oil composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the lubricating oil composition may have a total base number (TBN) of about 200 mg KOH/gram or greater, or as further examples, about 250 mg KOH/gram or greater, or about 350 mg KOH/gram or greater, or about 375 mg KOH/gram or greater, or about 400 mg KOH/gram or greater.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased calcium phenate detergents have a total base number of at least 150 mg KOH/g, at least about 225 mg KOH/g, at least 225 mg KOH/g to about 400 mg KOH/g, at least about 225 mg KOH/g to about 350 mg KOH/g or about 230 to about 350 mg KOH/g, all as measured by the method of ASTM D-2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

The overbased detergent may have a metal to substrate ratio of from 1.1:1, or from 2:1, or from 4:1, or from 5:1, or from 7:1, or from 10:1.

In some embodiments, a detergent is effective at reducing or preventing rust in an engine.

The detergent may be present at about 0 wt % to about 10 wt %, or about 0.1 wt % to about 8 wt %, or about 1 wt % to about 4 wt %, or greater than about 4 wt % to about 8 wt %.

Dispersants

The lubricating oil composition may optionally further comprise one or more dispersants or mixtures thereof. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with a number average molecular weight of the polyisobutylene substituent in the range about 350 to about 50,000 g/mol, or to about 5,000, or to about 3,000 g/mol. Succinimide dispersants and their preparation are disclosed, for instance in U.S. Pat. Nos. 7,897,696 or 4,234,435. The polyolefin may be prepared from polymerizable monomers containing about 2 to about 16, or about 2 to about 8, or about 2 to about δ carbon atoms. Succinimide dispersants are typically the imide formed from a polyamine, typically a poly(ethyleneamine).

Preferred amines are selected from polyamines and hydroxyamines Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like.

A suitable heavy polyamine is a mixture of polyalkylene-polyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogens per molecule and with 2 or more primary amines per molecule. The heavy polyamine comprises more than 28 wt. % (e.g. >32 wt. %) total nitrogen and an equivalent weight of primary amine groups of 120-160 grams per equivalent.

Suitable polyamines are commonly known as PAM, and contain a mixture of ethylene amines where TEPA and pentaethylene hexamine (PEHA) are the major part of the polyamine, usually less than about 80%.

Typically PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogens and more extensive branching, may produce dispersants with improved dispersancy.

In an embodiment the present disclosure further comprises at least one polyisobutylene succinimide dispersant derived from polyisobutylene with number average molecular weight in the range of about 350 g/mol to about 50,000 g/mol, or to about 5000 g/mol, or to about 3000 g/mol. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 g/mol to about 5000 g/mol is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 g/mol to about 3000 g/mol may be suitable. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights.

In one embodiment, the dispersant may be derived from a polyalphaolefin (PAO) succinic anhydride.

In one embodiment, the dispersant may be derived from olefin maleic anhydride copolymer. As an example, the dispersant may be described as a poly-PIBSA.

In an embodiment, the dispersant may be derived from an anhydride which is grafted to an ethylene-propylene copolymer.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 describe suitable post-treatment methods and post-treated dispersants.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003. Such treatments include, treatment with:

Inorganic phosphorous acids or anhydrates (e.g., U.S. Pat. Nos. 3,403,102 and 4,648,980);

Organic phosphorous compounds (e.g., U.S. Pat. No. 3,502,677);

Phosphorous pentasulfides;

Boron compounds as already noted above (e.g., U.S. Pat. Nos. 3,178,663 and 4,652,387);

Carboxylic acid, polycarboxylic acids, anhydrides and/or acid halides (e.g., U.S. Pat. Nos. 3,708,522 and 4,948,386);

Epoxides polyepoxiates or thioexpoxides (e.g., U.S. Pat. Nos. 3,859,318 and 5,026,495);

Aldehyde or ketone (e.g., U.S. Pat. No. 3,458,530);

Carbon disulfide (e.g., U.S. Pat. No. 3,256,185);

Glycidol (e.g., U.S. Pat. No. 4,617,137);

Urea, thourea or guanidine (e.g., U.S. Pat. Nos. 3,312,619; 3,865,813; and British Patent GB 1,065,595);

Organic sulfonic acid (e.g., U.S. Pat. No. 3,189,544 and British Patent GB 2,140,811);

Alkenyl cyanide (e.g., U.S. Pat. Nos. 3,278,550 and 3,366,569);

Diketene (e.g., U.S. Pat. No. 3,546,243);

A diisocyanate (e.g., U.S. Pat. No. 3,573,205);

Alkane sultone (e.g., U.S. Pat. No. 3,749,695);

1,3-Dicarbonyl Compound (e.g., U.S. Pat. No. 4,579,675);

Sulfate of alkoxylated alcohol or phenol (e.g., U.S. Pat. No. 3,954,639);

Cyclic lactone (e.g., U.S. Pat. Nos. 4,617,138; 4,645,515; 4,668,246; 4,963,275; and 4,971,711);

Cyclic carbonate or thiocarbonate linear monocarbonate or polycarbonate, or chloroformate (e.g., U.S. Pat. Nos. 4,612,132; 4,647,390; 4,648,886; 4,670,170);

Nitrogen-containing carboxylic acid (e.g., U.S. Pat. No. 4,971,598 and British Patent GB 2,140,811);

Hydroxy-protected chlorodicarbonyloxy compound (e.g., U.S. Pat. No. 4,614,522);

Lactam, thiolactam, thiolactone or ditholactone (e.g., U.S. Pat. Nos. 4,614,603 and 4,666,460);

Cyclic carbonate or thiocarbonate, linear monocarbonate or plycarbonate, or chloroformate (e.g., U.S. Pat. Nos. 4,612,132; 4,647,390; 4,646,860; and 4,670,170);

Nitrogen-containing carboxylic acid (e.g., U.S. Pat. No. 4,971,598 and British Patent GB 2,440,811);

Hydroxy-protected chlorodicarbonyloxy compound (e.g., U.S. Pat. No. 4,614,522);

Lactam, thiolactam, thiolactone or dithiolactone (e.g., U.S. Pat. Nos. 4,614,603, and 4,666,460);

Cyclic carbamate, cyclic thiocarbamate or cyclic dithiocarbamate (e.g., U.S. Pat. Nos. 4,663,062 and 4,666,459);

Hydroxyaliphatic carboxylic acid (e.g., U.S. Pat. Nos. 4,482,464; 4,521,318; 4,713,189);

Oxidizing agent (e.g., U.S. Pat. No. 4,379,064);

Combination of phosphorus pentasulfide and a polyalkylene polyamine (e.g., U.S. Pat. No. 3,185,647);

Combination of carboxylic acid or an aldehyde or ketone and sulfur or sulfur chloride (e.g., U.S. Pat. Nos. 3,390,086; 3,470,098);

Combination of a hydrazine and carbon disulfide (e.g. U.S. Pat. No. 3,519,564);

Combination of an aldehyde and a phenol (e.g., U.S. Pat. Nos. 3,649,229; 5,030,249; 5,039,307);

Combination of an aldehyde and an O-diester of dithiophosphoric acid (e.g., U.S. Pat. No. 3,865,740);

Combination of a hydroxyaliphatic carboxylic acid and a boric acid (e.g., U.S. Pat. No. 4,554,086);

Combination of a hydroxyaliphatic carboxylic acid, then formaldehyde and a phenol (e.g., U.S. Pat. No. 4,636,322);

Combination of a hydroxyaliphatic carboxylic acid and then an aliphatic dicarboxylic acid (e.g., U.S. Pat. No. 4,663,064);

Combination of formaldehyde and a phenol and then glycolic acid (e.g., U.S. Pat. No. 4,699,724);

Combination of a hydroxyaliphatic carboxylic acid or oxalic acid and then a diisocyanate (e.g. U.S. Pat. No. 4,713,191);

Combination of inorganic acid or anhydride of phosphorus or a partial or total sulfur analog thereof and a boron compound (e.g., U.S. Pat. No. 4,857,214);

Combination of an organic diacid then an unsaturated fatty acid and then a nitrosoaromatic amine optionally followed by a boron compound and then a glycolating agent (e.g., U.S. Pat. No. 4,973,412);

Combination of an aldehyde and a triazole (e.g., U.S. Pat. No. 4,963,278);

Combination of an aldehyde and a triazole then a boron compound (e.g., U.S. Pat. No. 4,981,492);

Combination of cyclic lactone and a boron compound (e.g., U.S. Pat. Nos. 4,963,275 and 4,971,711).

The TBN of a suitable dispersant may be from about 10 to about 65 on an oil-free basis, which is comparable to about 5 to about 30 TBN if measured on a dispersant sample containing about 50% diluent oil.

The dispersant, if present, can be used in an amount sufficient to provide up to about 20 wt %, based upon the final weight of the lubricating oil composition. Another amount of the dispersant that can be used may be about 0.1 wt % to about 15 wt %, or about 0.1 wt % to about 10 wt %, or about 3 wt % to about 10 wt %, or about 1 wt % to about 6 wt %, or about 7 wt % to about 12 wt %, based upon the final weight of the lubricating oil composition. In some embodiments, the lubricating oil composition utilizes a mixed dispersant system. A single type or a mixture of two or more types of dispersants in any desired ratio may be used.

Friction Modifiers

The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

A friction modifier may optionally be present in ranges such as about 0 wt % to about 10 wt %, or about 0.01 wt % to about 8 wt %, or about 0.1 wt % to about 4 wt %.

Molybdenum-Containing Component

The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan 822™, Molyvan™ A, Molyvan 2000™ and Molyvan 855™ from R. T. Vanderbilt Co., Ltd., and Sakura-Lube™ S-165, S-200, S-300, S-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, MoOCl4, MoO2Br2, Mo2O3Cl6, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Another class of suitable organo-molybdenum compounds are trinuclear molybdenum compounds, such as those of the formula Mo3SkLnQz and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-Containing Compounds

In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl-(or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

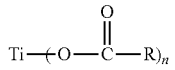

wherein n is an integer selected from 2, 3 and 4, and R is a hydrocarbyl group containing from about 5 to about 24 carbon atoms, or by the formula:

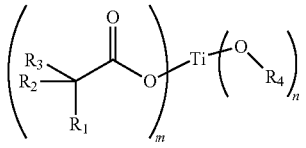

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or by the formula:

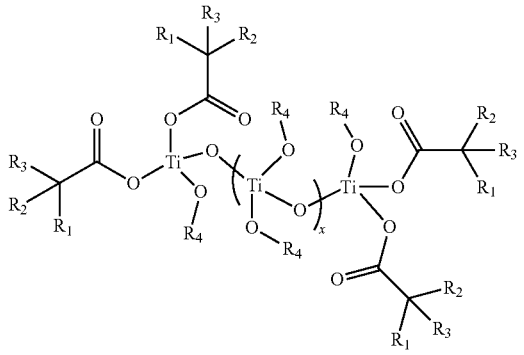

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Modifier

The lubricating oil compositions herein may also optionally contain one or more viscosity modifiers (also known as viscosity index improvers). Suitable viscosity modifiers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity modifiers may include star polymers and suitable examples are described in US Publication No. 20120101017A1.

The lubricating oil compositions herein also may optionally contain an additional dispersant viscosity modifier in addition to a viscosity modifier or in lieu of a viscosity modifier. Suitable viscosity modifier may include functionalized polyolefins other than the dispersant viscosity modifiers of the present disclosure, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity modifier and/or additional dispersant viscosity modifier may be about 0 wt % to about 20 wt %, about 0.1 wt % to about 15 wt %, about 0.1 wt % to about 12 wt %, or about 0.5 wt % to about 10 wt %, of the lubricating oil composition.

Other Optional Additives

Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 g/mol to about 3000 g/mol and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, a suitable lubricating oil composition may include additive components in the ranges listed in the following table.

TABLE 2

| Component | Wt % (Suitable Embodiments) | Wt % (Suitable Embodiments) |
|---|---|---|
| Dispersant(s) | 0-10.0 | 1.0-6.0 |
| Antioxidant(s) | 0-5.0 | 0.01-3.0 |
| Detergent(s) | 0.1-15.0 | 0.1-8.0 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) | 0.0-25.0 | 0.1-15.0 |
| Dispersant viscosity modifier(s) | 0.1-5.0 | 0.3-2.0 |
| Friction modifier(s) | 0.0-2.0 | 0.1-1.0 |
| Viscosity modifier | 0-20 | 0.25-10 |
| Base oil(s) | Balance | Balance |
| Total | 100 | 100 |

The percentages of each component above represent the weight percent of each component, based upon the weight of the final lubricating oil composition. The remainder of the lubricating oil composition consists of one or more base oils.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

EXAMPLES

The following examples are illustrative, but not limiting, of the methods and compositions of the present disclosure.

AC-1: Preparation of an Acylated Ethylene-Propylene Copolymer

A multifunctional olefin copolymer was prepared by the same general method which is previously described in the literature. An acylated ethylene-propylene copolymer having a number average molecular weight of approximately 40,000 g/mol, as determined by GPC, was obtained. The reaction stoichiometry and reaction conditions were such that 8.2 molecules of maleic anhydride were grafted onto the olefin copolymer backbone, corresponding to about 0.41 carboxylic groups per 1,000 Mn of the polymer backbone (i.e. 2×8.2=16.4 carboxylic groups/40,000 Mn=0.41 carboxylic groups/1000 Mn).

AC-2: Preparation of an Acylated Ethylene Propylene Copolymer

An acylated ethylene-propylene copolymer having an average molecular weight of approximately 56,000 $M_n$ was obtained by grafting maleic anhydride onto an ethylene-propylene copolymer. The reaction stoichiometry and reaction conditions were such that 11.4 molecules of maleic anhydride were grafted onto the olefin copolymer backbone, corresponding to about 0.41 carboxylic groups per 1,000 Mn of the polymer backbone (i.e. 2×11.4=22.8 carboxylic groups/56,000 Mn=0.41 carboxylic groups/1000 Mn).

LA-1: Preparation of the Reaction Product of N-Phenyl-p-Phenylenediamine and ε-Caprolactone A 500 mL 4 neck resin kettle was equipped with a heating mantle, a pitched 3 blade overhead stirrer, a thermocouple, a nitrogen inlet, a nitrogen outlet and a condenser. 39.47 g (0.3458 moles) of ε-caprolactone, 63.71 g (0.3458 moles) of N-phenyl-p-phenylenediamine (NPPDA), and 197 mL of toluene was added to the kettle. The reaction was heated to 95° C. to prevent solvent loss, at a constant stir rate of 200 rpm and under an active nitrogen flow for 6 hours. Once reacted, the product was cooled to room temperature (20-25° C.) and two equivalent volumes of heptane were added. The mixture was then cooled in an ice bath for 1 hour as two immiscible layers formed. The solvent was removed with a separatory funnel and the resulting dark violet liquid was collected.

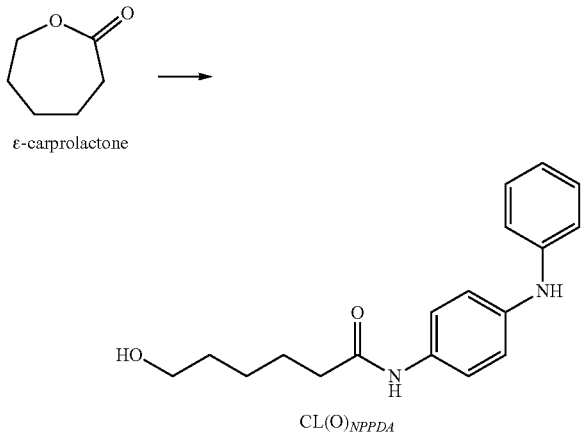

LA-2: Preparation of the Reaction Product of N-Phenyl-p-Phenylenediamine and Undecanoic δ-Lactone This example was carried out in a similar manner to LA-1, except instead of ε-caprolactone, 22.90 g (0.1238 moles) of undecanoic ε-lactone was used and the NPPDA and toluene were present in amounts of 22.80 g (0.1238 moles) and 254.55 mL, respectively. Upon cooling the mixture was cooled in the ice bath for 1 hour a dark violet precipitate formed. The solvent was removed via vacuum filtration and the resulting dark violet grainy solid was collected.

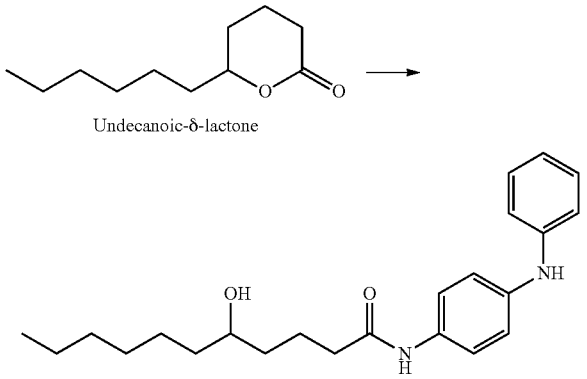

LA-3: Preparation of the Reaction Product of N-Phenyl-p-Phenylenediamine and Undecanoic γ-Lactone This example was carried out in a similar manner to LA-2, except instead of undecanoic 5-lactone, undecanoic γ-lactone was used. The undecanoic γ-lactone, the NPPDA and toluene were employed in amounts of 23.8 g (0.1292 moles), 23.8 g (0.1292 moles) and 254.4 mL, respectively.

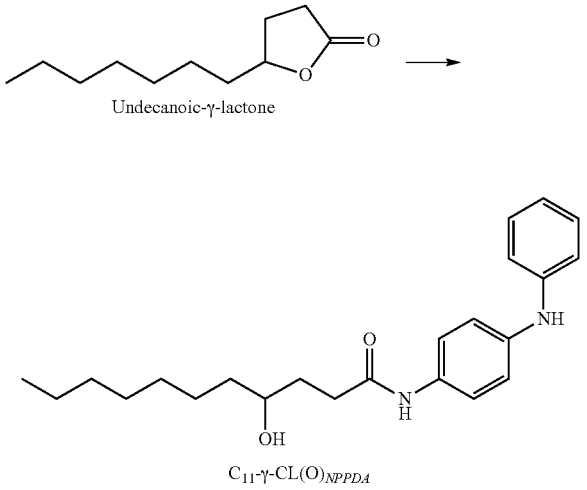

LA-4: Preparation of the Reaction Product of N-Phenyl-p-Phenylenediamine and γ-Octanoiclactone This example was carried out in a similar manner to LA-2, except instead of undecanoic δ-lactone, 24.90 g (0.1752 moles) of γ-octanoiclactone was used and the NPPDA and toluene were present in amounts of 32.25 g (0.1752 moles) and 242.85 mL, respectively. After the mixture was cooled in the ice bath for 1 hour, a dark reddish grainy precipitate formed. The solvent was removed via vacuum filtration and the resulting dark reddish grainy solid was collected.

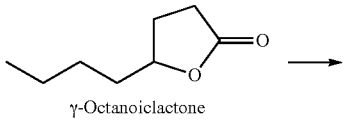

-continued

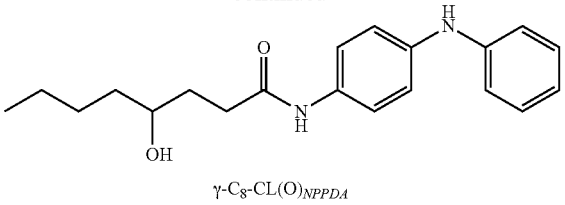

LA-5: Preparation of the Reaction Product of N-Phenyl-p-Phenylenediamine and II-Pentadecalactone A 500 mL 4 neck resin kettle was equipped with a heating mantle, a pitched 3 blade overhead stirrer, a thermocouple, a nitrogen inlet, a nitrogen outlet and a condenser. 21.25 g (0.0884 moles) of Ω-pentadecalactone, 16.28 g (0.0884 moles) of N-phenyl-p-phenylenediamine (NPPDA), and 262.47 mL of toluene was added to the kettle. The reaction was heated to 95° C. to prevent solvent loss, at a constant stir rate of 200 rpm and under an active nitrogen flow for 6 hours. Once reacted, the product was cooled to room temperature (20-25° C.) and two equivalent volumes of heptane were added. The mixture was then cooled in an ice bath for 1 hour as dark violet crystals formed. The solvent was removed via vacuum filtration and the resulting dark violet crystals were collected.

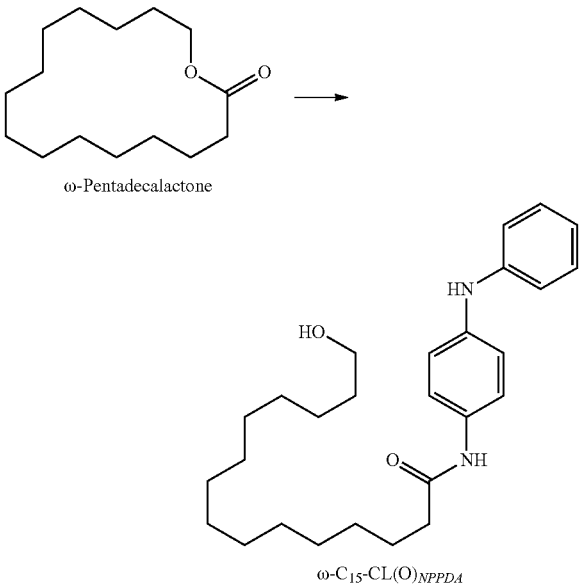

Example 1

A 1.0 L 4 neck resin kettle equipped with a heating mantle, a pitched 3 blade overhead stirrer, a thermocouple, a nitrogen inlet, nitrogen outlet and condenser was provided. 72 g of the polymer prepared in AC-2, and 504.73 g of a Group I base oil were added to the reactor. The reaction mixture was heated to 150° C. at a constant stir rate of 300 rpm and under active nitrogen flow to complete dissolution of the polymer. The temperature was increased to 165° C., the stirring was maintained at 300 rpm, and a mixture of the surfactant or processing aid surfonic L24-2 (18.0 g), and the product prepared in LA-1 (5.256 g, 17.6 mmoles) was added. After 6 hours, the reaction mixture was allowed to cool to 130° C. and was filtered through a 100 mesh (140 μm) filter. The product was allowed to cool to room temperature and was tested for tribological, viscometric, and dispersant properties.

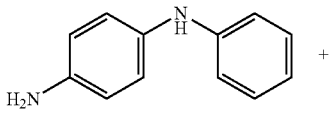

N-Phenyl-1,4-phenylenediamine

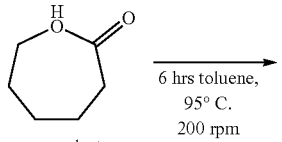

ε-caprolactone 6 hrs toluene, 95° C. 200 rpm $N_{2(g)}$ (1:1)

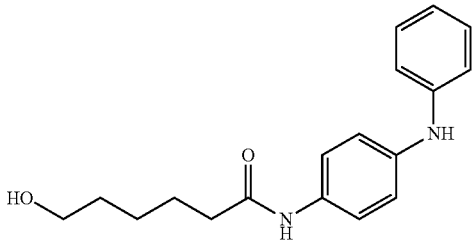

Reaction Product of Step A)

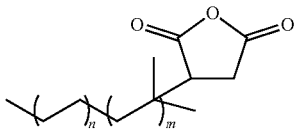

Acylated Polymer

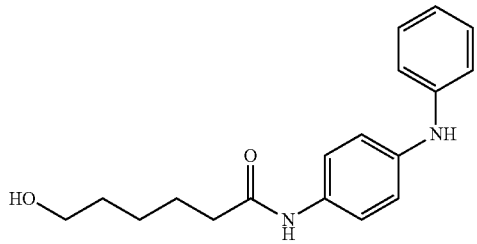

Reaction Product of Step A)

3 hrs, 165° C. Diluent Oil $N_{2(g)}$ 300 rpm (1:1)

-continued

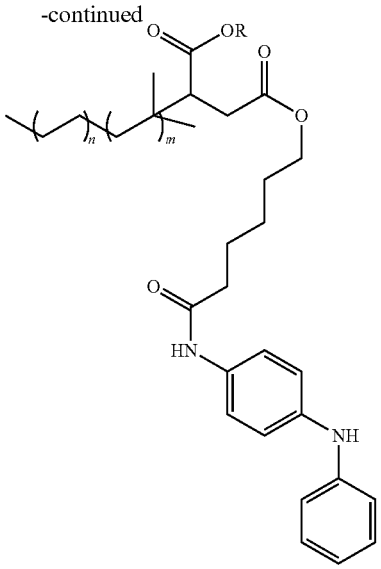

Example 2

A 500 mL 4 neck resin kettle equipped with a heating mantle, a pitched 3 blade overhead stirrer, a thermocouple, a nitrogen inlet, nitrogen outlet and condenser was provided. 36 g of the polymer prepared in AC-2, and 504.73 g of a Group I base oil were added to the reactor. The reaction mixture was heated to 150° C. at a constant stir rate of 300 rpm and under active nitrogen flow to complete dissolution of the polymer. The temperature was increased to 165° C., the stirring was maintained at 300 rpm and NPPDA (0.16 g, 0.8684 mmol) was added to the reaction mixture and allowed to react for 3 hours under constant nitrogen flow. Then, a mixture of the surfactant, surfonic L24-2 (18.0 g) and the product prepared in LA-1 (2.37 g, 9.14 mmoles) was added. After 6 hours, the reaction mixture was allowed to cool to 130° C. and was filtered through a 100 mesh (140 μm) filter. The product was allowed to cool to room temperature and was tested for tribological, viscometric, and dispersant properties.

Example 3

A 500 mL 4 neck resin kettle equipped with a heating mantle, a pitched 3 blade overhead stirrer, a thermocouple, a nitrogen inlet, nitrogen outlet and condenser was provided. 36 g of the polymer prepared in AC-2, and 250.98 g of a Group I base oil were added to the reactor. The reaction mixture was heated to 150° C. at a constant stir rate of 300 rpm and under active nitrogen flow to complete dissolution of the polymer. The temperature was increased to 165° C., the stirring was maintained at 300 rpm, and a mixture of the surfactant surfonic L24-2 (9.0 g) and the product prepared in LA-1 (2.62 g, 8.78 mmoles) was added. After 2 hours, 1-naphthalenemethanol (1.40 g, 8.84 mmol) was added to the reaction mixture and the reaction mixture was held at a temperature of 165° C. Finally the reaction mixture was allowed to cool to 130° C. and was filtered through a 100 mesh (140 μm) filter. The product was allowed to cool to room temperature and was tested for tribological, viscometric, and dispersant properties.

Example 4

A 500 mL 4 neck resin kettle equipped with a heating mantle, a pitched 3 blade overhead stirrer, a thermocouple, a nitrogen inlet, nitrogen outlet and condenser was provided. 36 g of the polymer prepared in AC-2, and 250.25 g of a Group I base oil were added to the reactor. The reaction mixture was heated to 150° C. at a constant stir rate of 300 rpm and under active nitrogen flow to complete dissolution of the polymer. The temperature was increased to 165° C., the stirring was maintained at 300 rpm, and a mixture of the surfactant surfonic L24-2 (9.0 g) and the product prepared in LA-1 (2.63 g, 8.81 mmoles) was added. After 3 hours, dioctylamine (2.12 g, 8.78 mmol) was added to the reaction mixture and the reaction mixture was held at a temperature of 165° C. Finally the reaction mixture was allowed to cool to 130° C. and was filtered through a 100 mesh (140 μm) filter. The product was allowed to cool to room temperature and was tested for tribological, viscometric, and dispersant properties.

Example 5

A 500 mL 4 neck resin kettle equipped with a heating mantle, a pitched 3 blade overhead stirrer, a thermocouple, a nitrogen inlet, a nitrogen outlet and condenser was provided. 36 g of the polymer prepared in AC-2, and 251.08 g of a Group I base oil were added to the reactor. The reaction mixture was heated to 150° C. at a constant stir rate of 300 rpm and under active nitrogen flow to complete dissolution of the polymer. The temperature was increased to 165° C., the stirring was maintained at 300 rpm, and a mixture of the surfactant surfonic L24-2 (9.0 g) and the product prepared in LA-1 (2.55 g, 8.54 mmoles) was added. After 3 hours, 2-phenyl-2-oxazoline (1.3 g, 8.83 mmol) was added to the reaction mixture and the reaction mixture was held at a temperature of 165° C. Finally the reaction mixture was allowed to cool to 130° C. and was filtered through a 100 mesh (140 μm) filter. The product was allowed to cool to room temperature and was tested for tribological, viscometric, and dispersant properties.

Example 6

A 500 mL 4 neck resin kettle equipped with a heating mantle, a pitched 3 blade overhead stirrer, a thermocouple, a nitrogen inlet, nitrogen outlet and condenser was provided. 36 g of the polymer prepared in AC-2, and 251.08 g of a Group I base oil were added to the reactor. The reaction mixture was heated to 150° C. at a constant stir rate of 300 rpm and under active nitrogen flow to complete dissolution of the polymer. The temperature was increased to 165° C., the stirring was maintained at 300 rpm, and a mixture of the surfactant surfonic L24-2 (9.0 g) and the product prepared in LA-1 (2.55 g, 8.54 mmoles) was added. After 3 hours, bis-(2-ethylhexyl)amine (2.12 g, 8.79 mmol) was added to the reaction mixture and the reaction mixture was held at a temperature of 165° C. Finally the reaction mixture was allowed to cool to 130° C. and was filtered through a 100 mesh (140 μm) filter. The product was allowed to cool to room temperature and was tested for tribological, viscometric, and dispersant properties.

Example 7

A 1.0 L 4 neck resin kettle equipped with a heating mantle, a pitched 3 blade overhead stirrer, a thermocouple, a nitrogen inlet, nitrogen outlet and condenser was provided. 72 g of the polymer prepared in AC-2, and 503.51 g of a Group I base oil were added to the reactor. The reaction mixture was heated to 150° C. at a constant stir rate of 300 rpm and under active nitrogen flow to complete dissolution of the polymer. The temperature was increased to 165° C., the stirring was maintained at 300 rpm, and a mixture of the surfactant surfonic L24-2 (18.0 g) and the product prepared in LA-2 (6.49 g, 26.13 moles) was added. After 6 hours the reaction mixture was allowed to cool to 130° C. and was filtered through a 100 mesh (140 μm) filter. The product was allowed to cool to room temperature and was tested for tribological, viscometric, and dispersant properties.

Example 8

A 1.0 L 4 neck resin kettle equipped with a heating mantle, a pitched 3 blade overhead stirrer, a thermocouple, a nitrogen inlet, nitrogen outlet and condenser was provided. 72 g of the polymer prepared in AC-2, and 503.52 g of a Group I base oil were added to the reactor. The reaction mixture was heated to 150° C. at a constant stir rate of 300 rpm and under active nitrogen flow to complete dissolution of the polymer. The temperature was increased to 165° C., the stirring was maintained at 300 rpm, and a mixture of the surfactant surfonic L24-2 (18.0 g) and the product prepared in LA-3 (6.49 g, 17.61 moles) was added. After 6 hours the reaction mixture was allowed to cool to 130° C. and was filtered through a 100 mesh (140 μm) filter. The product was allowed to cool to room temperature and was tested for tribological, viscometric, and dispersant properties.

Example 9

A 1.0 L 4 neck resin kettle equipped with a heating mantle, a pitched 3 blade overhead stirrer, a thermocouple, a nitrogen inlet, nitrogen outlet and condenser was provided. 72 g of the polymer prepared in AC-2, and 504.25 g of a Group I base oil were added to the reactor. The reaction mixture was heated to 150° C. at a constant stir rate of 300 rpm and under active nitrogen flow to complete dissolution of the polymer. The temperature was increased to 165° C., the stirring was maintained at 300 rpm, and a mixture of the surfactant surfonic L24-2 (18.0 g) and the product prepared in LA-4 (5.76 g, 19.88 moles) was added. After 6 hours the reaction mixture was allowed to cool to 130° C. and was filtered through a 100 mesh (140 μm) filter. The product was allowed to cool to room temperature and was tested for tribological, viscometric, and dispersant properties.

Example 10

A 1.0 L 4 neck resin kettle equipped with a heating mantle, a pitched 3 blade overhead stirrer, a thermocouple, a nitrogen inlet, nitrogen outlet and condenser was provided. 72 g of the polymer prepared in AC-2, and 502.53 g of a Group I base oil were added to the reactor. The reaction mixture was heated to 150° C. at a constant stir rate of 300 rpm and under active nitrogen flow to complete dissolution of the polymer. The temperature was increased to 165° C., the stirring was maintained at 300 rpm, and a mixture of the surfactant surfonic L24-2 (18.0 g) and the product prepared in LA-5 (7.48 g, 15.28 moles) was added. After 6 hours the reaction mixture was allowed to cool to 130° C. and was filtered through a 100 mesh (140 μm) filter. The product was allowed to cool to room temperature and was tested for tribological, viscometric, and dispersant properties.

COMPARATIVE EXAMPLES

LA-Cl: Preparation of the Reaction Product of N-phenyl-p-phenylenediamine and ε-caprolactam in Toluene A 500 mL 4 neck resin kettle was equipped with a heating mantle, a pitched 3 blade overhead stirrer, a thermocouple, a nitrogen inlet, a nitrogen outlet and a condenser. 39.47 g (0.3488 moles) of ε-caprolactam, 63.64 g (0.3488 moles) of N-phenyl-p-phenylenediamine (NPPDA), and 197 mL of toluene was added to the kettle. The reaction mixture was heated to 95° C. to prevent solvent loss, at a constant stir rate of 200 rpm and under an active nitrogen flow for 6 hours. Once reacted, the product was cooled to room temperature (20-25° C.). Then the mixture was placed in an ice bath for 1 hour. The solvent was removed through vacuum filtration and a dark violet solid was collected and dried in vacuo at 110° C.

LA-C2: Preparation of the Reaction Product of N-Phenyl-p-Phenylenediamine and ε-Caprolactam in Group I Base Oil

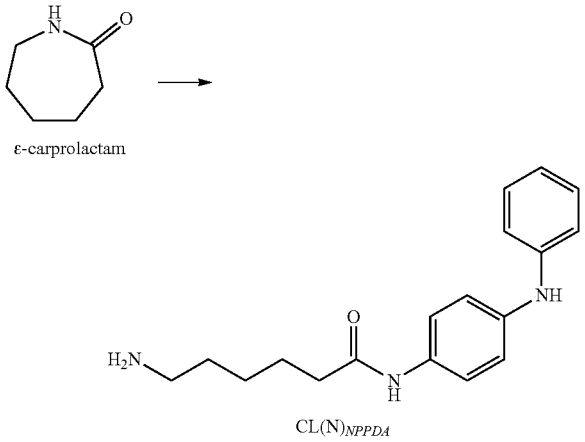

A 500 mL 4 neck resin kettle was equipped with a heating mantle, a pitched 3 blade overhead stirrer, a thermocouple, a nitrogen inlet, a nitrogen outlet and a condenser. 39.47 g (0.3488 moles) of ε-caprolactam, 63.64 g (0.3488 moles) of N-phenyl-p-phenylenediamine (NPPDA), and 197 g of group I base oil was added to the kettle. The reaction mixture was heated to 165° C. at a constant stir rate of 200 rpm and under an active nitrogen flow for 6 hours. Once reacted, the product was cooled to room temperature (20-25° C.). Then the mixture was placed in an ice bath for 1 hour.

LA-C3: Preparation of the Reaction Product of N-Phenyl-p-Phenylenediamine and Isatoic Anhydride This reaction product was prepared according to preparative example 2 of U.S. Pat. No. 8,912,133 B2. Specifically, the composition was prepared by charging a solution of aminodiphenylamine (NPPDA) in toluene with isatoic anhydride, such that the aminodiphenylamine and isatoic anhydride were added in a 1:1 ratio. The composition was heated to reflux under a nitrogen atmosphere and stirred for 6 hours. After cooling the resultant product was isolated via filtration yielding a dark-blue powder.

Comparative Example 1

The product of Comparative Example 1 was prepared using a 500 mL 4 neck resin kettle equipped with a heating mantle, a pitched 3 blade overhead stirrer, a thermocouple, a nitrogen inlet, nitrogen outlet and condenser. 30 g of the polymer prepared in AC-2, and 209.24 g of a Group I base oil were added to the reactor. The reaction mixture was heated to 150° C. at a constant stir rate of 300 rpm and under active nitrogen flow to complete dissolution of the polymer. The temperature was increased to 165° C. and 2.18 g (0.0119 moles) of the product prepared in LA-Cl was added. After 3 hours the surfactant surfonic L24-2 (3.0 g) was added to the reaction mixture and the reaction mixture was held at 165° C. for an additional 2 hours. The reaction mixture was allowed to cool to 130° C. and was filtered through a 100 mesh (140 μm) filter. The product was allowed to cool to room temperature and was tested for tribological, viscometric, and dispersant properties.

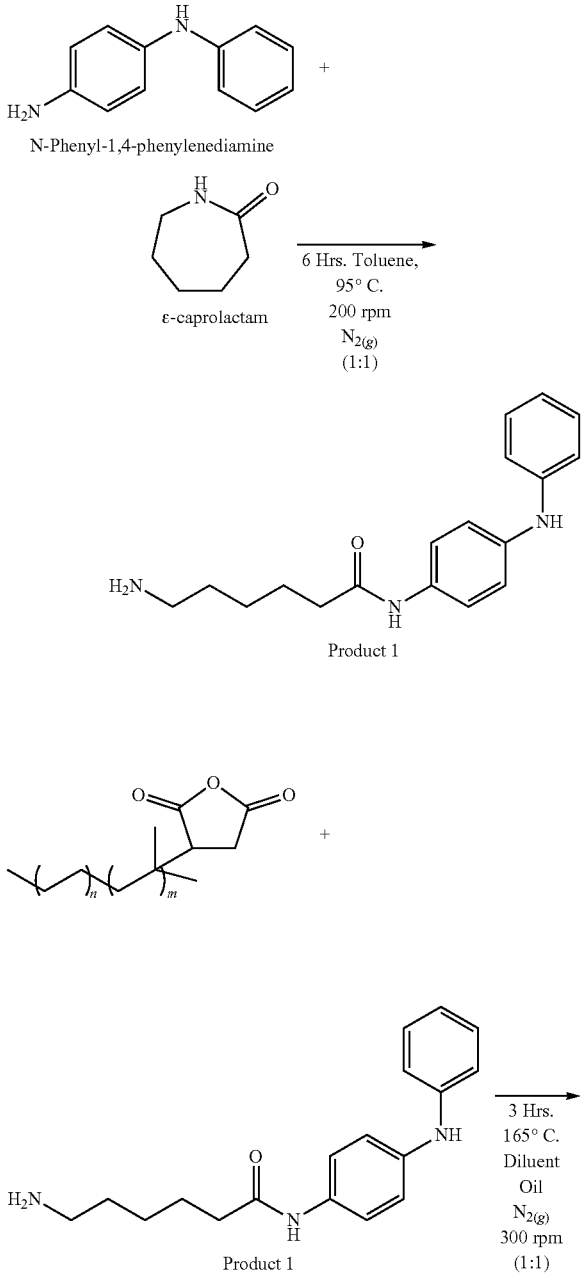

-continued

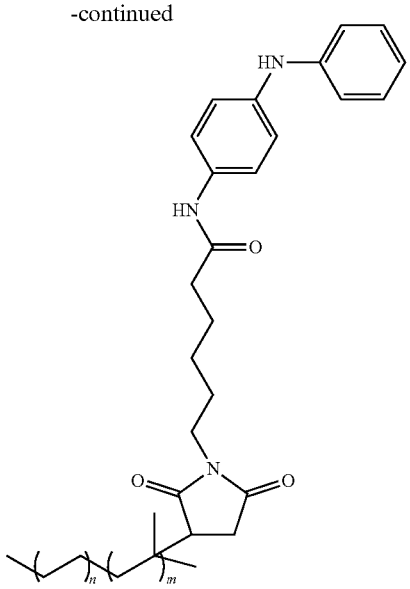

Comparative Example 2

The product of Comparative Example 2 was prepared using a 1.0 L 4 neck resin kettle equipped with a heating mantle, a pitched 3 blade overhead stirrer, a thermocouple, a nitrogen inlet, nitrogen outlet and condenser. 30 g of the polymer prepared in AC-2, and 503.88 g of a Group I base oil were added to the reactor. The reaction mixture was heated to 150° C. at a constant stir rate of 300 rpm and under active nitrogen flow to complete dissolution of the polymer. The temperature was increased to 165° C. and 6.12 g (20.2 mmoles) of the product prepared in LA-C3 was added. After 3 hours the surfactant surfonic L24-2 (9.0 g) was added to the reaction mixture and the reaction mixture was held at 165° C. for an additional 2 hours. The reaction mixture was allowed to cool to 130° C. and was filtered through a 100 mesh (140 μm) filter. The product was allowed to cool to room temperature and was tested for tribological, viscometric, and dispersant properties.

Comparative Example 3

HiTEC® 5748A is a commercially available olefin copolymer viscosity index improver from Afton Chemical Corporation which is recommended for use in industrial, gasoline and diesel crankcase lubricants, particularly when excellent shear stability is desired. Comparative Example 1 employed HiTEC® 5748A in the same amount as was used in the other formulations mentioned in Table below.

Mini Traction Machine

The Mini Traction Machine (MTM) is an industry standard for measuring thin-film friction coefficients (TFF) under various sliding and rolling conditions. A steel ball is loaded against the face of a disc where the ball and disc are independently driven to create mixed rolling and sliding contact. The frictional forces (i.e. the coefficient of friction) between the ball and the disc are measured by a force transducer. The ability of lubricant to reduce thin film friction is reflected by the determined thin-film lubrication regime traction coefficients. A lower value is indicative of lower friction.

TABLE 3

| | MTM |
|---|---|
| Examples | |
| Example 1 | 0.043 |
| Example 2 | 0.044 |
| Example 3 | 0.051 |
| Example 4 | 0.044 |
| Example 5 | 0.040 |
| Example 6 | 0.044 |
| Example 7 | 0.045 |
| Example 8 | 0.048 |
| Example 9 | 0.049 |
| Comparative Examples | |
| C.E. 1 | 0.049 |
| C.E. 2 | 0.046 |
| C.E. 3 | 0.064 |

High Frequency Reciprocating Rig

The engine oil lubricants were subjected to the High Frequency Reciprocating Rig (HFRR) test. A HFRR from PCS Instruments was used to measure boundary lubrication regime friction coefficients. The test samples are measured by submerging the contact between an SAE 52100 metal ball and an SAE 52100 metal disk in a temperature controlled bath under a fixed load forwards and backwards at a set stroke frequency. The friction coefficients were measured at temperatures of 70° C., 100° C. and 130° C. and the friction coefficient, temperature, and electrical contact resistance were monitored throughout the test. The ability of the lubricant to reduce boundary layer friction is reflected by the determined boundary lubrication regime friction coefficient. A lower value of this friction coefficient is indicative of lower friction.

TABLE 4

| | HFRR | | |
|---|---|---|---|
| Polymer | 70° C. | 100° C. | 130° C. |
| Example 1 | 0.127 | 0.117 | 0.113 |
| Example 2 | 0.125 | 0.115 | 0.110 |
| Example 3 | 0.125 | 0.113 | 0.104 |
| Example 4 | 0.124 | 0.118 | 0.111 |
| Example 5 | 0.126 | 0.120 | 0.113 |
| Example 7 | 0.128 | 0.120 | 0.116 |
| Example 8 | 0.131 | 0.121 | 0.122 |
| Example 9 | 0.127 | 0.120 | 0.114 |
| Example 10 | 0.130 | 0.121 | 0.116 |
| C.E. 1 | 0.129 | 0.120 | 0.109 |
| C.E. 2 | 0.130 | 0.121 | 0.114 |
| C.E. 3 | 0.129 | 0.119 | 0.113 |

Dispersancy

This Example evaluates the performance of a lubricating oil including additives of the above Comparative and Inventive Examples. The exemplary polymers and comparative polymers were evaluated for the dispersant viscosity modification properties.

The performance of the exemplary polymers and the comparative polymers formulated in a lubricating oil is shown in FIG. 1. The results of dispersancy testing and an effective concentration for each of the example polymers are provided in Table 5 below. The effective concentration shown in Table 5 is the minimum amount of copolymer needed to completely disperse soot at which point the rheological profile becomes flat or Newtonian. The actual amount of polymer used in a lubricant may be higher depending on other properties desired for the lubricant.

In order to evaluate lubricant formulations according to this disclosure, the polymers were tested for their ability to disperse soot. Without dispersant, an oil containing soot particles has a shear thinning (non-Newtonian) behavior where viscosity decreases with increasing shear rate due to the agglomeration of soot particles at low shear rates resulting in higher viscosity, while at higher shear rates, soot particle agglomeration was broken up resulting in lower viscosity. If an additive with dispersant capability is added to a sooted oil, soot particles are protected by the dispersant to prevent agglomeration, and thus an oil containing a sufficient amount of an additive with dispersant capability has an ideal viscosity behavior or Newtonian fluid behavior where viscosity is independent of shear rate. See, e.g., Thomas G. Mezger, The Rheology Handbook, 3rd Revised Edition, 2011.

Based on this, a dispersancy test was designed to test the effectiveness of the inventive polymers at dispersing soot particles using a Physica MCR 301 Rheometer (Anton Parr). A sooted oil have about 4.6 weight percent soot was generated from a fired diesel engine using a fluid that contained no dispersants. The sooted oil was then top treated with a certain amount of the inventive and comparative [olymers and then tested by a shear rate sweep in a rheometer with a cone on plate to determine Newtonian/non-Newtonian behavior. The test temperature was about 100° C. and the test top plate was a CP50-1 (Anton Parr). A profile of viscosity and shear rate was recorded, and the results may be seen in FIG. 1.

In FIG. 1, the curve labeled "Sooted Oil alone" represents the viscosity versus shear rate curve before addition of any dispersants. As expected, a shear thinning behavior was observed since soot particles were agglomerated. Comparative Example 2 (not capped or treated with oxazoline) showed a curve of decreasing viscosity with increasing shear rate at 0.5 wt % of polymer, which indicates that it was a shear thinning (non-Newtonian) fluid and the soot was agglomerating. The higher viscosity indicates that, at this treat rate, the polymer of Comparative Example 2 was effectively acting as a thickener by increasing the oil viscosity without fully dispersing the soot particles. The higher viscosity at the lower shear indicates soot agglomeration. The Inventive Polymers 5 and 7 provided a lower viscosity relative to the polymer of Comparative Example 2, which was indicative of improved dispersant properties. Examples 8 and 10 showed a relatively lower viscosity and a relatively constant viscosity versus shear rate at a treat rate of 0.5 wt %, when compared to the sooted oil without additive.

For the tests shown in FIG. 1, the amounts of polymer tested ranged between 0.2 and 0.6 weight percent depending on the polymer, and more specifically, the treat rates of the polymers were as follows: 0.2 wt % for Example 2, 0.3 wt % for Example 3, 0.4 wt % for Example 4, and 0.6 wt % for Comparative Example 2. Furthermore, the viscosities for the sooted oils containing inventive polymers 2, 3, and 4 at low shear are lower than the viscosity of the sooted oil containing the polymer of Comparative Example 2. These results show that the inventive polymers effectively dispersed the soot particles at each of the treat rates that were employed.

TABLE 5

| Polymer | Dispersancy (Effective concentration) |
|---|---|
| Example 1 | 1.08 |
| Example 2 | 1.07 |
| Example 3 | 1.05 |
| Example 4 | 0.77 |
| Example 5 | 1.16 |
| Example 7 | 1.07 |
| Example 8 | 1.14 |
| Example 9 | 0.66 |
| Example 10 | 0.62 |
| C.E. 1 | N.D. |
| C.E. 2 | 1.7 |
| C.E. 3 | N.D. |

*N.D. = Not Detectable

Finished oil formulations were formulated with proportional base oil ratios to assess the viscometric contribution of the dispersant viscosity modifier. In general, cold cranking temperature performance was improved in the inventive examples compared to, for example, Comparative Example 3. The improvement in the cold cranking temperature ranged from 10.4% to 12.7%. The formulations of examples 1, 2, 3, 5, 7, 8, and 9 all outperformed comparative example 3. The formulation of example 5 had the best overall performance.

TABLE 6

| | I.E. 1 | I.E. 2 | I.E. 3 | I.E. 4 | I.E. 5 | I.E. 7 | I.E. 8 | I.E. 9 | I.E. 10 |
|---|---|---|---|---|---|---|---|---|---|
| KV100° C. (Cst) | 10.84 | 10.91 | 10.92 | 10.97 | 10.84 | 10.96 | 10.9 | 10.82 | 10.93 |
| KV40° C. (Cst) | 72.94 | 70.63 | 70.84 | 74.97 | 71.92 | 73.96 | 74.96 | 72.61 | 76.12 |
| CCS-30 (Cp) | 6666 | 6596 | 6606 | 6774 | 6600 | 6652 | 6702 | 6684 | 6782 |
| MRV-35 (Cp) | 37000 | 39200 | 37800 | 38800 | 39700 | 41200 | 41900 | 39300 | 41900 |
| TBS (Cp) | 2.96 | 2.98 | 2.97 | 3.08 | 2.9 | 2.93 | 2.99 | 2.94 | 3.06 |
| D6616 (TBS) (Cp) | 6.57 | 6.44 | 6.43 | 6.7 | 6.42 | 6.68 | 6.8 | 6.68 | 6.89 |
| Viscosity Index | 138 | 144 | 144 | 135 | 140 | 137 | 134 | 138 | 132 |

TABLE 7

| | C.E. 1 | C.E. 2 | C.E. 3 |
|---|---|---|---|
| KV100° C. (Cst) | 12.22 | 10.9 | 11.07 |
| KV40° C. (Cst) | 78.8 | 72.1 | 68.51 |

TABLE 7-continued

| | C.E. 1 | C.E. 2 | C.E. 3 |
|---|---|---|---|
| CCS-30 (Cp) | 6587 | 6700 | 7558 |
| MRV-35 (Cp) | 37800 | 38900 | 29200 |
| TBS (Cp) | 2.86 | 2.96 | 3.31 |
| D6616 (TBS) (Cp) | 6.3 | 6.58 | 7.68 |
| Viscosity Index | 152 | 140 | 154 |

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the disclosure being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law. Other suitable modifications and adaptations of the variety of conditions and parameters normally encountered in the field, and which are obvious to those skilled in the art, are within the scope of the disclosure.

All patents and publications cited herein are fully incorporated by reference herein in their entirety or at least for the portion of their description for which they are specifically cited or relied upon in the present description.

The patentees do not intend to dedicate any disclosed embodiments to the public, and to the extent any disclosed modifications or alterations may not literally fall within the scope of the claims, they are considered to be part hereof under the doctrine of equivalents.

It is to be understood that each component, compound, substituent or parameter disclosed herein is to be interpreted as being disclosed for use alone or in combination with one or more of each and every other component, compound, substituent or parameter disclosed herein. It is also to be understood that each amount/value or range of amounts/values for each component, compound, substituent or parameter disclosed herein is to be interpreted as also being disclosed in combination with each amount/value or range of amounts/values disclosed for any other component(s), compounds(s), substituent(s) or parameter(s) disclosed herein and that any combination of amounts/values or ranges of amounts/values for two or more component(s), compounds(s), substituent(s) or parameters disclosed herein are thus also disclosed in combination with each other for the purposes of this description.

It is further understood that each range disclosed herein is to be interpreted as a disclosure of each specific value within the disclosed range that has the same number of significant digits. Thus, a range of from 1-4 is to be interpreted as an express disclosure of the values 1, 2, 3 and 4.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

The invention claimed is:

1. A lubricating oil composition comprising:

greater than 50 wt % of a base oil, based on the total weight of the lubricating oil composition, and 0.1 wt % to 20 wt %, based on the total weight of the lubricating oil composition, of a dispersant viscosity modifier obtainable by:

A) forming a reaction product by reacting components a) and b) in a molar ratio of about 1:1:

a) at least one of a lactone of formula (I) or a derivative thereof:

(I)

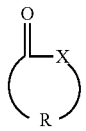

wherein X is oxygen, and R is an optionally substituted hydrocarbylene group having from 1 to 20 carbon atoms, wherein the hydrocarbylene group can be substituted with 1-3 substituents independently selected from halogen, hydroxyl, nitro, cyano, carboxy, and an alkyl or alkenyl group having 1 to 32 carbon atoms which may be linear or branched; and b) at least one compound selected from:

a linear, branched cyclic or aromatic amine comprising at least one primary or secondary amino group; and a linear, branched cyclic or aromatic alcohol comprising at least one primary or secondary alcohol according to Formula (III), or a tertiary alkyl or alkenyl alcohol according to Formula (IV), wherein Forumla (III) and Formula (IV) are as follows:

(III)

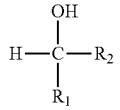

wherein $R_1$ is selected from hydrogen and an optionally substituted linear or branched alkyl or alkenyl group, and $R_2$ is an optionally substituted linear or branched alkyl or alkenyl group and the number of carbon atoms of $R_1$ and $R_2$ add to a total of 7 to 31 carbon atoms, and (IV)

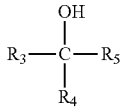

wherein $R_3$, $R_4$, and $R_5$ are each independently selected from an optionally substituted linear or branched alkyl or alkenyl group wherein the number of carbon atoms of $R_3$, $R_4$, and $R_5$ add to a total of 7 to 31 carbon atoms; and B) reacting the reaction product of step A) onto an acylated olefin copolymer obtainable by acylating a copolymer of ethylene and one or more $C_3$-$C_{10}$ alpha-olefins having a number average molecular weight (Mn) of 5,000 to 200,000 g/mol as measured by GPC, with an acylating agent.

2. The lubricating oil composition of claim 1, wherein the dispersant viscosity modifier is present in an amount of from about 0.1 wt % to about 10 wt %, based on the total weight of the lubricating oil composition.

3. The lubricating oil composition of claim 1, wherein the dispersant viscosity modifier is present in an amount of from about 0.5 wt % to about 8 wt %, based on the total weight of the lubricating oil composition.

4. The lubricating oil composition of claim 1, wherein the dispersant viscosity modifier is present in an amount of 1 wt % to about 5 wt %, based on the total weight of the lubricating oil composition.

5. The lubricating oil composition of claim 1, wherein the base oil is selected from a Group II base oil having at least 90 wt % saturates, a Group III base oil having at least 90 wt % saturates, a Group IV base oil, a Group V base oil and mixtures of two or more thereof.

6. The lubricating oil composition of claim 1, wherein the copolymer is an ethylene-propylene copolymer.

7. The lubricating oil composition of claim 1, wherein the copolymer is acylated with an ethylenically unsaturated acylating agent having at least one carboxylic acid or carboxylic anhydride group.

8. The lubricating oil composition of claim 7, wherein the acylating agent is maleic anhydride.

9. The lubricating oil composition of claim 1, wherein component b) is an N-arylphenylene diamine of the formula II:

II

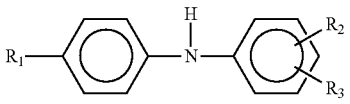

wherein $R_1$ is hydrogen, —NH-aryl, —NH-arylalkyl, —NH-alkyl or a branched or straight chain radical having from 4 to 24 carbon atoms selected from an alkyl group, an alkenyl group, an alkoxyl group, an aralkyl group, an alkaryl group, a hydroxyalkyl group and an aminoalkyl group; $R_2$ is —$NH_2$, $CH_2$—$(CH_2)_n$—$NH_2$, or $CH_2$-aryl-$NH_2$, in which n has a value from 1 to 10; and $R_3$ is selected from a hydrogen, an alkyl group, an alkenyl group, an alkoxyl group, an aralkyl group, and an alkaryl group having from 4 to 24 carbon atoms.

10. The lubricating oil composition of claim 9, wherein component b) is selected from the group consisting of 1-(2-amino-ethyl)imidazolidin-2-one, 4-(3-aminopropyl) morpholine, 3-(dimethylamino)-1-propylamine, N-phenyl-p-phenylenedi amine, N-(3-aminopropyl)-2-pyrrolidinone, aminoethyl-acetamide, β-alanine methyl ester, 1-(3-aminopropyl)imidazole, branched β-amines, arylamines, polyetheramines, and poly(arylamines).

11. The lubricating oil composition of claim 9, wherein component b) is selected from the group consisting of N-phenyl-1,4-phenylenediamine, N-phenyl-1,3-phenylendiamine, and N-phenyl-1,2-phenylenediamine.

12. The lubricating oil composition of claim 9, wherein the amine is N-phenyl-1,4-phenylenediamine.

13. The lubricating oil composition of claim 1, wherein in step A) the lactone is employed and the lactone is selected from acetolactone, propiolactone, butyrolactone, valerolactone, caprolactone, δ-valerolactone, methyl-δ-valero-lactone, ε-caprolactone, methyl-ε-caprolactone, dimethyl-ε-caprolactone, methoxy-ε-caprolactone, cyclohexyl-ε-caprolactone, methylbenzyl-ε-caprolactone, caprylolactone, and methyl-caprylolactone.

14. The lubricating oil composition of claim 1, wherein the lactone is c-caprolactone.

15. The lubricating oil composition of claim 1, wherein the composition further comprises one or more of antioxidants, friction modifiers, anti-wear agents, detergents, anti-foam agents, process oil, and dispersants.

16. The lubricating oil composition of claim 1, wherein the dispersant viscosity modifier is further reacted with a component c), wherein component c) is at least one compound selected from:

a linear, branched cyclic or aromatic amine comprising at least one primary or secondary amino group; a linear, branched cyclic or aromatic alcohol comprising at least one primary, secondary, or tertiary alkyl or alkenyl alcohols; and an oxazoline.

17. The lubricating oil composition of claim 16, wherein component c) is selected from, N-phenyl-1,4-phenylenediamine, N-phenyl-1,3-phenylendiamine, N-phenyl-1,2-phenylenediamine, and dioctyl amine.

18. The lubricating oil composition of claim 16, wherein component c) is selected from the group consisting of 2-ethylhexanol, 2-butyloctanol, isomyristyl alcohol, 2-hexyldecanol, isostearyl alcohol, 2-octyldodecanol, 2-decyltetradecanol, 2-dodecylhexadecanol, 2-tetradecyloctadecanol 2-dodecylhexadecanol, 2-hexyloctanol 2-ethylhexanol, 2-hydroxy-2,3-dimethylhexane, 2-butylhexanol, 2-propylhexan-1-ol, 3-Propyl-1-hexanol, 3-methyl-1-heptanol, 3-ethylheptan-1-ol, 2-ethyl-4-methylhexan-1-ol, 2,4-diethylhexan-1-ol, 2-naphthol, benzyl alcohol, 3-phenoxybenzyl alcohol, 2-naphthylmethanol, 9-anthracenemethanol, 1-pyrenemethanol, 2-(9-anthracenylmethoxy)ethanol, 2-(9-anthracenyloxyethanol), and 1-naphthalene methanol.

19. The lubricating oil composition of claim 16, wherein component c) is 2-phenyl-2-oxazoline; 2-ethyl-2 oxazoline; 2-methyl-2-oxazoline; 2-benzyl-4,4-dimethyl-2-oxazoline;

2-ethyl-4,4-dimethyl-2 oxazoline; 2,4,4-trimethyl-2-oxazoline; 4,4-dimethyl-2-oxazoline; 2,4,5-trimethyl-3-oxazoline; 2-(2,6-dimethoxyphenyl)-4,4-dimethyl-2-oxazoline; 2-[1-(hydroxymethyl)ethyl] oxazoline; mixtures thereof, and derivatives thereof. In yet other approaches, the oxazoline or derivative thereof includes pendant groups in positions 2, 4, and 5 or combinations thereof wherein the pendant groups are selected from heterocyclic, aromatics, hydrocarbyl groups of $C_1$ to $C_{32}$, and mixtures thereof.

20. A method of improving the soot or sludge handling capability of an engine oil, comprising a step of lubricating an engine with the lubricating oil composition as claimed in claim 1.

21. The method of claim 20, wherein the improvement in soot or sludge handling is measured relative to a same lubricating oil composition that does not contain the dispersant viscosity modifier.

22. A method of improving thin film and boundary layer friction in an engine comprising the step of lubricating the engine with the lubricating oil composition as claimed in claim 1.

23. The method as claimed in claim 22, wherein the improved thin film and boundary layer friction is determined relative to a same composition that does not contain the dispersant viscosity modifier.

24. A method for improving boundary layer friction in an engine, comprising the step of lubricating the engine with the lubricating oil composition as claimed in claim 1.

25. The method as claimed in claim 24, wherein the improved boundary layer friction is determined relative to a same composition that does not contain the dispersant viscosity modifier.

26. A method for improving thin film friction in an engine, comprising the step of lubricating the engine with the lubricating oil composition as claimed in claim 1.

27. The method as claimed in claim 26, wherein the improved thin film friction is determined relative to a same composition in the absence of the dispersant viscosity modifier.

28. A process for making a polymeric composition comprising the steps of:

A) forming a reaction product by reacting components a) and b) in a molar ratio of about 1:1:

a) a lactone of formula (I) or a derivative thereof:

(I)

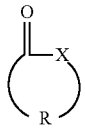

wherein X is oxygen, and R is an optionally substituted hydrocarbylene group having from 1 to 20 carbon atoms, wherein the hydrocarbylene group can be substituted with 1-3 substituents independently selected from halogen, hydroxyl, nitro, cyano, carboxy, and an alkyl or alkenyl group having 1 to 32 carbon atoms which may be linear or branched; and b) at least one compound selected from:

a linear, branched cyclic or aromatic amine comprising at least one primary or secondary amino group;

a linear, branched cyclic or aromatic alcohol comprising at least one primary, or secondary alcohol according to Formula (III), or a tertiary alkyl or alkenyl alcohol according to Formula (IV), wherein Formula (III) and Formula (IV) are as follows:

(III)

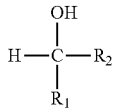

wherein $R_1$ is selected from hydrogen and an optionally substituted linear or branched alkyl or alkenyl group, and $R_2$ is an optionally substituted linear or branched alkyl or alkenyl group and the number of carbon atoms of $R_1$ and $R_2$ add to a total of 7 to 31 carbon atoms, and (IV)

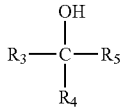

wherein $R_3$, $R_4$, and $R_5$ are each independently selected from an optionally substituted linear or branched alkyl or alkenyl group wherein the number of carbon atoms of $R_3$, $R_4$, and $R_5$ add to a total of 7 to 31 carbon atoms; and B) reacting the reaction product of step A) to an acylated olefin copolymer obtainable by acylating a copolymer of ethylene and one or more $C_3$-$C_{10}$ alpha-olefins having a number average molecular weight Mn of 5,000 to 200,000 g/mol as measured by GPC.

29. The method of claim 28, wherein the acylated olefin copolymer is reacted with a component c) prior to reacting with the reaction product of step A), wherein component c) is at least one compound selected from:

a linear, branched cyclic or aromatic amine comprising at least one primary or secondary amino group;

a linear, branched cyclic or aromatic alcohol comprising at least one primary, secondary, or tertiary alkyl or alkenyl alcohols; and an oxazoline.

30. The method of claim 28, wherein step B) is carried out at a temperature range of from 115° C. to 250° C.

31. The method of claim 29, wherein the reaction of the acylated olefin copolymer and component c) is carried out at a temperature of from 115° C. to 250° C. for 1 to 5 hours and step B) is carried out at a temperature of from 115° C. to 250° C.

32. A lubricating oil composition comprising:

greater than 50 wt % of a base oil, based on the total weight of the lubricating oil composition, and 0.1 wt % to 20 wt %, based on the total weight of the lubricating oil composition, of a dispersant viscosity modifier obtainable by:

A) forming a first reaction product by reacting components a) and b) in a molar ratio of about 1:1:

a) at least one of a lactone of formula (I) or a derivative thereof:

(I)

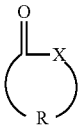

wherein X is oxygen, and R is an optionally substituted hydrocarbylene group having from 1 to 20 carbon atoms, wherein the hydrocarbylene group can be substituted with 1-3 substituents independently selected from halogen, hydroxyl, nitro, cyano, carboxy, and an alkyl or alkenyl group having 1 to 32 carbon atoms which may be linear or branched; and b) at least one compound selected from:

a linear, branched cyclic or aromatic amine comprising at least one primary or secondary amino group;

a linear, branched cyclic or aromatic alcohol comprising at least one primary or secondary alcohol according to Formula (III), or a tertiary alkyl or alkenyl alcohol according to Formula (IV), wherein Formula (III) and Formula (IV) are as follows:

(III)

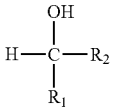

wherein $R_1$ is selected from hydrogen and an optionally substituted linear or branched alkyl or alkenyl group, and $R_2$ is an optionally substituted linear or branched alkyl or alkenyl group and the number of carbon atoms of $R_1$ and $R_2$ add to a total of 7 to 31 carbon atoms, and (IV)

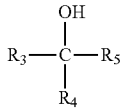

wherein $R_3$, $R_4$, and $R_5$ are each independently selected from an optionally substituted linear or branched alkyl or alkenyl group wherein the number of carbon atoms of $R_3$, $R_4$, and $R_5$ add to a total of 7 to 31 carbon atoms; and B) forming a second reaction product by reacting:

c) at least one compound selected from:

a linear, branched cyclic or aromatic amine comprising at least one primary or secondary amino group;

a linear, branched cyclic or aromatic alcohol comprising at least one primary, secondary, or tertiary alkyl or alkenyl alcohols; and an oxazoline; and d) an acylated olefin copolymer obtainable by acylating a copolymer of ethylene and one or more $C_3$-$C_{10}$ alpha-olefins having a number average molecular weight (Mn) of 5,000 to 200,000 g/mol as measured by GPC, with an acylating agent;

C) reacting the first and the second reaction product of steps A) and B).

33. The lubricating oil composition of claim 32, wherein component b) is an amine, and component c) is an amine.

34. The lubricating oil composition of claim 33, wherein the amine of components b) and c) is N-phenyl-1,4-phenylenediamine.

* * * * *